US010262663B2

(12) United States Patent
Krueger et al.

(10) Patent No.: US 10,262,663 B2
(45) Date of Patent: Apr. 16, 2019

(54) METHOD AND APPARATUS FOR LOW BIT RATE COMPRESSION OF A HIGHER ORDER AMBISONICS HOA SIGNAL REPRESENTATION OF A SOUND FIELD

(71) Applicant: DOLBY LABORATORIES LICENSING CORPORATION, San Francisco, CA (US)

(72) Inventors: Alexander Krueger, Hannover (DE); Sven Kordon, Wunstorf (DE); Florian Keiler, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/509,596

(22) PCT Filed: Sep. 25, 2015

(86) PCT No.: PCT/EP2015/072064
§ 371 (c)(1),
(2) Date: Mar. 8, 2017

(87) PCT Pub. No.: WO2016/055284
PCT Pub. Date: Apr. 14, 2016

(65) Prior Publication Data

US 2017/0243589 A1 Aug. 24, 2017

(30) Foreign Application Priority Data

Oct. 10, 2014 (EP) ..... 14306607

(51) Int. Cl.
*H04S 3/02* (2006.01)
*G10L 19/008* (2013.01)

(52) U.S. Cl.
CPC ..... *G10L 19/008* (2013.01); *H04S 3/02* (2013.01); *H04S 2420/11* (2013.01)

(58) Field of Classification Search
CPC ..... G10L 19/008; H04S 3/02; H04S 2420/11
See application file for complete search history.

(56) References Cited

FOREIGN PATENT DOCUMENTS

| | | |
|---|---|---|
| EP | 2665208 | 11/2013 |
| EP | 2743922 | 6/2014 |

(Continued)

OTHER PUBLICATIONS

Jérôme Daniel Représentation de champs acoustiques, application à la transmission et à la reproduction de scènes sonores complexes dans un contexte multimédia. PhD thesis, Université Paris 6, 2001.

(Continued)

*Primary Examiner* — Davetta W Goins
*Assistant Examiner* — Daniel R Sellers

(57) ABSTRACT

The invention is suited for improving a low bit rate compressed and decompressed Higher Order Ambisonics HOA signal representation of a sound field, wherein the decompression provides a spatially sparse decoded HOA representation and a set of indices of coefficient sequences of this representation. From reconstructed signals of the original HOA representation a number of modified phase spectra signals are created using de-correlation filters, which modified phase spectra signals are uncorrelated with the signals of said original representation. The modified phase spectra signals are mixed with each other using predetermined mixing parameters, in order to provide a replicated ambient HOA component. Finally the spatially sparse decoded HOA representation is enhanced with the replicated time domain HOA representation.

17 Claims, 5 Drawing Sheets

(56) References Cited

FOREIGN PATENT DOCUMENTS

| | | |
|---|---|---|
| EP | 2993665 | 3/2016 |
| WO | 2014/177455 | 11/2014 |

OTHER PUBLICATIONS

ISO/IEC JTC1/SC29. N8324—Text of ISO/IEC FDIS 23003-1, MPEG Surround. MPEG, Klagenfurt, Audio Subgroup, Jul. 2006.
ISO/IEC JTC 1/SC29, 23008-3 "Information Technology-High Efficiency Coding and Media Delivery in Heterogenous Environments—Part 3:3D Audio" Jul. 25, 2014.
Lee, D. et al. "Learning the parts of objects by nonnegative matrix factorization", MacMillan Magazines Ltd. Nature, vol. 401, Oct. 21, 1999, pp. 788-791.
Ville Pulkki, "Directional audio coding in spatial sound reproduction and stereo upmixing", Directional Audio Coding in Spatial Sound, AES 28th International Conference, Pitea, Sweden, Jun. 30-Jul. 2, 2006.
Boaz Rafaely, "Plane-wave decomposition of the sound field on a sphere by spherical convolution", J. Acoust. Soc. Am. 4(116): 2149-2157, Oct. 2004.
Vilkamo, J. et al "Optimized covariance domain framework for time-frequency processing of spatial audio" J. Audio Eng. Soc., vol. 61, No. 6, Jun. 2013, pp. 403-411.
Earl G. Williams "Fourier Acoustics Sound Radiation and Nearfield Acoustical Holography", vol. 93 of Applied Mathematical Sciences. Academic Press, 1999.
ISO/IEC JTC1/SC29-WG11 N14264 "WD1-HOA Text of MPEG-H 3D Audio" Jan. 2014, San Jose, USA Audio-Subgroup.
Jurgen, H. et al "MPEG-H Audio—The New Standard for Universal Spatial/3D Audio Co." AES Convention 137, Oct. 2014, pp. 8-9.
Sen, Deep et al "RM1-HOA Working Draft Text" MPEG Meeting Jan. 13-17, 2014, Spatial HOA Encoding, pp. 64-75.

METHOD AND APPARATUS FOR LOW BIT RATE COMPRESSION OF A HIGHER ORDER AMBISONICS HOA SIGNAL REPRESENTATION OF A SOUND FIELD

TECHNICAL FIELD

The invention relates to a method and to an apparatus for low bit rate compression of a Higher Order Ambisonics HOA signal representation of a sound field, wherein the HOA signal representation is spatially sparse due to the low bit rate.

BACKGROUND

Higher Order Ambisonics (HOA) offers one possibility to represent three-dimensional sound, among other techniques like wave field synthesis (WFS) or channel based approaches like 22.2. In contrast to channel based methods, however, the HOA representation offers the advantage of being independent of a specific loudspeaker set-up. But this flexibility is at the expense of a decoding process which is required for the playback of the HOA representation on a particular loudspeaker set-up. Compared to the WFS approach, where the number of required loudspeakers is usually very large, HOA may also be rendered to set-ups consisting of only few loud-speakers. A further advantage of HOA is that the same representation can also be employed without any modification for binaural rendering to headphones.

HOA is based on the representation of the spatial density of complex harmonic plane wave amplitudes by a truncated Spherical Harmonics (SH) expansion. Each expansion coefficient is a function of angular frequency, which can be equivalently represented by a time domain function. Hence, without loss of generality, the complete HOA sound field representation actually can be assumed to consist of O time domain functions, where O denotes the number of expansion coefficients. These time domain functions will be equivalently referred to as HOA coefficient sequences or as HOA channels in the following.

The spatial resolution of the HOA representation improves with a growing maximum order N of the expansion. Unfortunately, the number of expansion coefficients O grows quadratically with the order N, in particular $O=(N+1)^2$. For example, typical HOA representations using order N=4 require O=25 HOA (expansion) coefficients. According to the previously made considerations, the total bit rate for the transmission of HOA representation, given a desired single-channel sampling rate $f_S$ and the number of bits $N_b$ per sample, is determined by $O \cdot f_S \cdot N_b$. Consequently, transmitting an HOA representation of order N=4 with a sampling rate of $f_S$=48 kHz employing $N_b$=16 bits per sample results in a bit rate of 19.2 MBits/s, which is very high for many practical applications like streaming for example. Thus, compression of HOA representations is highly desirable.

The compression of HOA sound field representations was proposed in EP 2665208 A1, EP 2743922 A1 and International application PCT/EP2013/059363, cf. ISO/IEC DIS 23008-3, MPEG-H 3D audio, July 2014. These approaches have in common that they perform a sound field analysis and decompose the given HOA representation into a directional and a residual ambient component. The final compressed representation is on one hand assumed to consist of a number of quantised signals, resulting from the perceptual coding of directional and vector-based signals as well as relevant coefficient sequences of the ambient HOA component. On the other hand it is assumed to comprise additional side information related to the quantised signals, which is necessary for the reconstruction of the HOA representation from its compressed version.

A reasonable minimum number of quantised signals is '8' for the approaches in EP 2665208 A1, EP 2743922 A1 and International application PCT/EP2013/059363. Hence, the data rate with one of these methods is typically not lower than 256 kbit/s assuming a data rate of 32 kbit/s for each individual perceptual coder. For certain applications, like e.g. the audio streaming to mobile devices, this total data rate might be too high, which makes desirable HOA compression methods for significantly lower data rates, e.g. 128 kbit/s.

In European patent application EP 14306077.0 a method for the low bit-rate compression of HOA representations of sound fields is described that uses a smaller number of quantised signals, which are basically a small subset of the original HOA representation. For the replication of the missing HOA coefficients, prediction parameters are obtained for different frequency bands in order to predict additional directional HOA components from the quantised signals.

SUMMARY OF INVENTION

In the EP 14306077.0 processing, the reconstructed HOA representation consists of highly correlated components because all HOA components are reconstructed from only a small number of quantised signals. Due to such small number of quantised signals, the prediction of directional HOA components thereof can be unsatisfactory and can lead to the effect that the reconstructed HOA representation is spatially sparse. This can make the sound dry and quieter than in the original HOA representation. Ambient sound fields, which typically consist of spatially uncorrelated signal components, are not reconstructed properly if the number of quantised signals is very small, e.g. '1' or '2'.

The processing described in the following deals with compression of Higher Order Ambisonics representation at low bit rates, and re-creates the ambient sound field components, and it improves the above-described EP 14306077.0 processing in case of a very small number of quantised signals.

The processing described is called Parametric Ambience Replication (PAR), and it complements a reconstructed, spatially sparse HOA representation by potentially missing ambient components, which are parametrically replicated from itself. The replication is performed by first creating from the signals of the sparse HOA representation (which may include directional signals and an ambient component) a number of new signals with modified phase spectra, thus being uncorrelated with the former signals. Second, the newly created signals are mixed with each other in order to provide a replicated ambient HOA component. The final enhanced HOA representation is computed by the superposition of the original sparse HOA representation and the replicated ambient HOA component. The mixing is carried out so as to match the spatial acoustic properties of the final enhanced HOA representation with that of the original HOA representation. Preferably, the mixing is performed in the frequency domain, offering the possibility to vary between different frequency bands. Assuming the process of creating the uncorrelated signals from the sparse HOA representation to be deterministically specified, the side information for PAR to be included into the compressed HOA representation consists only of the mixing parameters, which are essentially complex-valued mixing matrices.

One particular method for creating the uncorrelated signals from the sparse HOA representation with the goal to reduce the amount of side information for PAR is to first represent the sparse HOA representations by virtual loudspeaker signals (or equivalently by general plane wave functions) from some predefined directions, which should be distributed on the unit sphere as uniformly as possible. The rendering for creating the virtual loudspeaker signals from the HOA representation is referred to as a spatial transform in the following. Second, for each of these directions one uncorrelated signal is created by modifying the phase spectrum of the corresponding virtual loudspeaker signal of the sparse HOA representation using a de-correlation filter. Third, the replicated ambient HOA component is also represented by virtual loudspeaker signals for the same directions, where each virtual loudspeaker signal for a certain direction is mixed only from uncorrelated signals created for predefined directions in the neighbourhood of that particular direction. The mixing from only a small number of uncorrelated signals offers the advantage that the number of mixing coefficients to create one uncorrelated signal can be kept low, as well as the amount of side information for PAR. Another advantage is that for the mixing of the individual virtual loudspeaker signals of the replicated ambient HOA component only signals from the spatial neighbourhood, and thus with similar amplitude spectrum, are considered. This operation prevents that directional components of the sparse HOA representation are undesirably spatially distributed over all directions. For this approach it is assumed that the de-correlation filters are pairwise different and that their number is equal to the number of virtual loudspeaker directions. The practical construction of many such de-correlation filters usually causes each individual filter to have only a limited de-correlation effect. The assignment of the de-correlation filters to the virtual directions (or equivalently spatial positions) should be reasonably chosen in order to minimise the mutual correlation between the signals to be mixed for creating a single virtual loudspeaker signal of the replicated ambient HOA component.

The number of virtual loudspeaker directions is allowed to vary for individual frequency bands and can be used for specifying a frequency-dependent order of the replicated ambient HOA component.

A further extension of the method of creating the uncorrelated signals from the sparse HOA representation is the usage of a time-varying number of uncorrelated signals to be considered for the mixing of a virtual loudspeaker signal of the replicated ambient HOA component. The number of uncorrelated signals to be mixed depends on the amount of missing ambience in the sparse HOA representation. This variation usually would lead to changes in the assignment of the de-correlation filters to the virtual loudspeaker positions. In order to avoid discontinuities of the de-correlated signals due to the temporal assignment change, the assignment of the de-correlation filters to the virtual loudspeaker signals of the sparse HOA representation can be exchanged by an equivalent assignment of the virtual loudspeaker signals to the de-correlation filters. This assignment can be expressed by a simple permutation matrix. In case the assignment changes, the input to each de-correlation filter can be computed by overlap-add between the signals arising from two different assignments. Hence, the input to and output of each de-correlation filter is continuous. Afterwards, the assignment has to be inverted in order to re-assign the output of each de-correlation filter to each virtual loudspeaker direction.

In the context of multi-channel audio, the problem of creating ambient sound components is addressed in V. Pulkki, "Directional audio coding in spatial sound reproduction and stereo upmixing", in AES 28th International Conference, Piteå, Sweden, June 2006, in J. Vilkamo, T. Baeckstroem, A. Kuntz, "Optimized covariance domain framework for time-frequency processing of spatial audio", J. Audio Eng. Soc, vol. 61(6), pages 403-411, 2013, in ISO/IEC 23003-1 MPEG Surround, and in ISO/IEC 23003-2 Spatial Audio Object Coding.

This application, however, describes a processing for the creation of ambience in the context of HOA representations.

In principle, the inventive compression improving method is adapted for improving a low bit rate compressed and decompressed Higher Order Ambisonics HOA signal representation of a sound field, so as to provide a Parametric Ambience Replication parameter set, wherein said decompression provides a spatially sparse decoded HOA representation and a set of indices of coefficient sequences of this representation, said method including:

transforming said spatially sparse decoded HOA representation into a number of complex-valued frequency domain sub-band representations and transforming using an analysis filter bank a correspondingly delayed version of said HOA signal representation into a corresponding number of complex-valued frequency domain sub-band representations;

grouping said sub-bands into a number of sub-band groups, and within each of these sub-band groups:

creating, using de-correlation filters, for each sub-band in a sub-band group from said complex-valued frequency domain sub-band representation a number of modified phase spectra signals which are uncorrelated with said complex-valued frequency domain sub-band representation;

computing for each sub-band in a sub-band group from said modified phase spectra signals a decorrelation covariance matrix;

transforming for each sub-band in a sub-band group said complex-valued frequency domain sub-band representation into its spatial domain representation and computing therefrom a corresponding covariance matrix;

transforming for each sub-band in a sub-band group a complex-valued frequency domain sub-band representation for said HOA signal representation into its spatial domain representation and computing therefrom a corresponding covariance matrix, for each sub-band group:

for all sub-bands of a sub-band group, combining said decorrelation covariance matrices so as to provide a sub-band group decorrelation covariance matrix $\tilde{\Sigma}_{DECO,g}(k'-1)$;

for all sub-bands of a sub-band group, combining the covariance matrices for said spatial domain representation of said complex-valued frequency domain sub-band representations so as to provide a sub-band group covariance matrix $\tilde{\Sigma}_{SPARS,g}(k'-1)$;

for all sub-bands of a sub-band group, combining the covariance matrices for said spatial domain representation of said complex-valued frequency domain sub-band representations for said HOA signal representation so as to provide a sub-band group covariance matrix $\tilde{\Sigma}_{ORIG,g}(k'-1)$;

forming the residual between the combined covariance matrices $\tilde{\Sigma}_{ORIG,g}(k'-1)$ and $\tilde{\Sigma}_{SPARS,g}(k'-1)$, so as to provide a matrix $\Delta\Sigma_g(k'-1)$;

computing, using matrix $\tilde{\Sigma}_{DECO,g}(k'-1)$ and matrix $\Delta\Sigma_g(k'-1)$, a corresponding mixing matrix;

encoding said mixing matrix so as to provide a parameter set for the sub-band group;

multiplexing said parameter sets for said sub-band groups and encoded sub-band configuration data and Parametric Ambience Replication coding parameters so as to provide a Parametric Ambience Replication parameter set.

In principle, the inventive compression improving apparatus is adapted for improving a low bit rate compressed and decompressed Higher Order Ambisonics HOA signal representation of a sound field, so as to provide a Parametric Ambience Replication parameter set, wherein said decompression provides a spatially sparse decoded HOA representation and a set of indices of coefficient sequences of this representation, said apparatus including means adapted to:

transform said spatially sparse decoded HOA representation into a number of complex-valued frequency domain sub-band representations and transform using an analysis filter bank a correspondingly delayed version of said HOA signal representation into a corresponding number of complex-valued frequency domain sub-band representations;

group said sub-bands into a number of sub-band groups, and within each of these sub-band groups:

create, using de-correlation filters, for each sub-band in a sub-band group from said complex-valued frequency domain sub-band representation a number of modified phase spectra signals which are uncorrelated with said complex-valued frequency domain sub-band representation;

compute for each sub-band in a sub-band group from said modified phase spectra signals a decorrelation covariance matrix;

transform for each sub-band in a sub-band group said complex-valued frequency domain sub-band representation into its spatial domain representation and compute therefrom a corresponding covariance matrix;

transform for each sub-band in a sub-band group a complex-valued frequency domain sub-band representation for said HOA signal representation into its spatial domain representation and compute therefrom a corresponding covariance matrix, for each sub-band group:

for all sub-bands of a sub-band group, combine said decorrelation covariance matrices so as to provide a sub-band group decorrelation covariance matrix $\tilde{\Sigma}_{DECO,g}(k'-1)$;

for all sub-bands of a sub-band group, combine the covariance matrices for said spatial domain representation of said complex-valued frequency domain sub-band representations so as to provide a sub-band group covariance matrix $\tilde{\Sigma}_{SPARS,g}(k'-1)$;

for all sub-bands of a sub-band group, combine the covariance matrices for said spatial domain representation of said complex-valued frequency domain sub-band representations for said HOA signal representation so as to provide a sub-band group covariance matrix $\tilde{\Sigma}_{ORIG,g}(k'-1)$;

form the residual between the combined covariance matrices $\tilde{\Sigma}_{ORIG,g}(k'-1)$ and $\tilde{\Sigma}_{SPARS,g}(k'-1)$, so as to provide a matrix $\Delta\Sigma_g(k'-1)$;

compute, using matrix $\tilde{\Sigma}_{DECO,g}(k'-1)$ and matrix $\Delta\Sigma_g(k'-1)$, a corresponding mixing matrix;

encode said mixing matrix so as to provide a parameter set for the sub-band group;

multiplex said parameter sets for said sub-band groups and encoded sub-band configuration data and Parametric Ambience Replication coding parameters so as to provide a Parametric Ambience Replication parameter set.

In principle, the inventive decompression improving method is adapted for improving a spatially sparse decoded HOA representation, for which a set of indices of coefficient sequences of this representation was provided by said decoding, using a Parametric Ambience Replication parameter set generated according to the above compression improving method, said method including:

reconstructing from said spatially sparse decoded HOA representation, said set of indices of coefficient sequences and said Parametric Ambience Replication parameter set an improved HOA representation, said reconstructing including:

determining from said Parametric Ambience Replication parameter set a sub-band configuration;

converting said spatially sparse decoded HOA representation into a number of frequency-band HOA representations;

according to said sub-band configuration, allocating corresponding groups of frequency-band HOA representations together with related parameters to a corresponding number of Parametric Ambience Replication sub-band decoder steps or stages which create de-correlated coefficient sequences of a replicated ambience HOA representation;

transforming said coefficient sequences of said replicated ambience HOA representation to a replicated time domain HOA representation;

enhancing with said replicated time domain HOA representation said spatially sparse decoded HOA representation, so as to provide an enhanced decompressed HOA representation.

In principle, the inventive decompression improving apparatus is adapted for improving a spatially sparse decoded HOA representation, for which a set of indices of coefficient sequences of this representation was provided by said decoding, using a Parametric Ambience Replication parameter set generated according to the above compression improving method, said apparatus including means adapted to:

reconstruct from said spatially sparse decoded HOA representation, said set of indices of coefficient sequences and said Parametric Ambience Replication parameter set an improved HOA representation, wherein that reconstruction includes:

determine from said Parametric Ambience Replication parameter set a sub-band configuration;

convert said spatially sparse decoded HOA representation into a number of frequency-band HOA representations;

according to said sub-band configuration, allocate corresponding groups of frequency-band HOA representations together with related parameters to a corresponding number of Parametric Ambience Replication sub-band decoder steps or stages which create de-correlated coefficient sequences of a replicated ambience HOA representation;

transform said coefficient sequences of said replicated ambience HOA representation to a replicated time domain HOA representation;

enhance with said replicated time domain HOA representation said spatially sparse decoded HOA representation, so as to provide an enhanced decompressed HOA representation.

BRIEF DESCRIPTION OF DRAWINGS

Exemplary embodiments of the invention are described with reference to the accompanying drawings, which show in.

DESCRIPTION OF EMBODIMENTS

Even if not explicitly described, the following embodiments may be employed in any combination or sub-combination.

HOA Encoder

Figure 1:
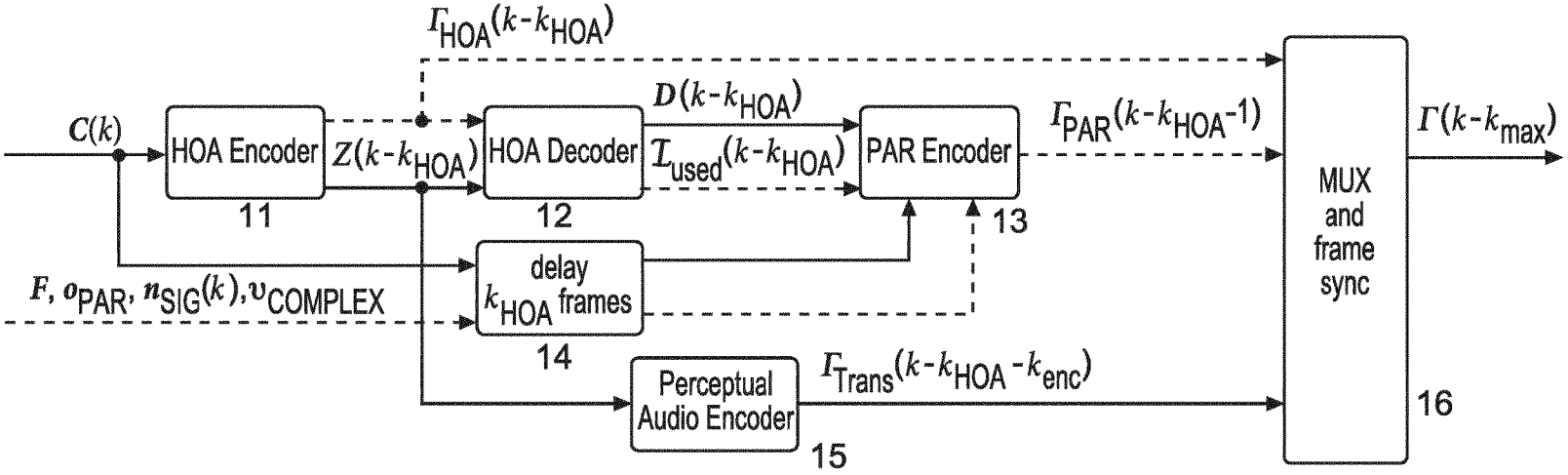
FIG. 1 HOA data encoder including a PAR encoder.

The Parametric Ambience Replication (PAR) processing is used as an additional coding tool that extends the basic HOA compression, like it is shown in FIG. 1, where a frame based processing of frames with a frame index k is assumed. The HOA encoder step or stage 11 decomposes the HOA representation C(k) into the transport signal matrix $Z(k-k_{HOA})$ and a set of HOA side information $\Gamma_{HOA}(k-k_{HOA})$ like it is described in EP 2665208 A1, EP 2743922 A1, International application PCT/EP2013/059363 and European patent application EP 14306077.0. The HOA representation matrix C(k) for the frame index k consists of O rows, where each row holds L time domain samples of the corresponding HOA coefficient, and it is also fed to a frame delay step or stage 14. The rows of the matrix $Z(k-k_{HOA})$ hold the L time domain samples of the transport signals in which C(k) has been composed. The time domain signals from $Z(k-k_{HOA})$ are perceptually encoded in perceptual audio encoder step or stage 15 to the transport signal parameter set $\Gamma_{Trans}$ $(k-k_{HOA}-k_{enc})$ which are fed to a multiplexer and frame synchronisation step or stage 16. The O×L matrix $D(k-k_{HOA})$ of the sparse HOA representation is restored from $\Gamma_{HOA}(k-k_{HOA})$ and $Z(k-k_{HOA})$ in a HOA decoder step or stage 12, which also provides a set of active ambience coefficients $\mathcal{I}_{used}(k-k_{HOA})$ This HOA decoder step/stage 12 is identical to the HOA decoder step or stage 43 used in the HOA data decompressor shown in FIG. 4.

The term 'sparse' or 'spatially sparse HOA representation' means that in this representation spatially uncorrelated signal components of the original sound field are missing. In particular, the term 'sparse' may, but does not have to mean that the most coefficient sequences of the respective HOA representation are zero. E.g. a sound field that is coded/represented by only two plane waves is meant to be spatially sparse. However, usually none of the respective HOA coefficient sequences will be zero.

The sparse HOA representation $D(k-k_{HOA})$ is fed into a PAR encoder step or stage 13 together with the delay-compensated HOA representation $C(k-k_{HOA})$, the set of active ambience coefficients $\mathcal{I}_{used}(k-k_{HOA})$, and PAR encoder parameters F, $o_{PAR}$, $n_{SIG}(k-k_{HOA})$ and $v_{COMPLEX}$ delay compensated in step/stage 14. The PAR processing is performed in $N_{SB}$ sub-band groups, where the rows of the matrix F hold the first and the last sub-band index of the PAR filter bank for each corresponding sub-band group. The vector $o_{PAR}$ contains for all PAR sub-band groups the HOA order used for the processing. The index set $\mathcal{I}_{used}(k-k_{HOA})$ holds the indexes of the rows from $D(k-k_{HOA})$ that are used for the PAR processing. The number of spatial domain signals per sub-band group that are used to compute one spatial domain signal of the replicated ambient HOA representation is defined by the vector $n_{SIG}(k)$ for frame k. The vector $v_{COMPLEX}$ indicates for each sub-band group whether the elements of the PAR mixing matrix are complex-valued numbers or real-valued non-negative numbers. From these input signals and parameters the PAR encoder computes the encoded PAR parameter set $\Gamma_{PAR}(k-k_{HOA}-1)$ that is also fed to step/stage 16.

Multiplexer and frame synchronisation step/stage 16 synchronises the frame delays of the parameter sets $\Gamma_{HOA}(k-k_{HOA})$, $\Gamma_{PAR}(k-k_{HOA}-1)$ and $\Gamma_{Trans}(k-k_{HOA}-k_{enc})$, and combines them into the coded HOA frame $\Gamma(k-k_{max})$.

The HOA encoder delay is defined by $k_{HOA}$, where it is assumed that the HOA decoder does not introduce any additional delay. The same definitions hold for the perceptual encoder delay $k_{enc}$. The PAR processing adds also one frame of delay, so that the overall delay is $k_{max}=\max\{k_{HOA}+k_{enc},k_{HOA}+1\}$.

PAR Encoder

Figure 2:
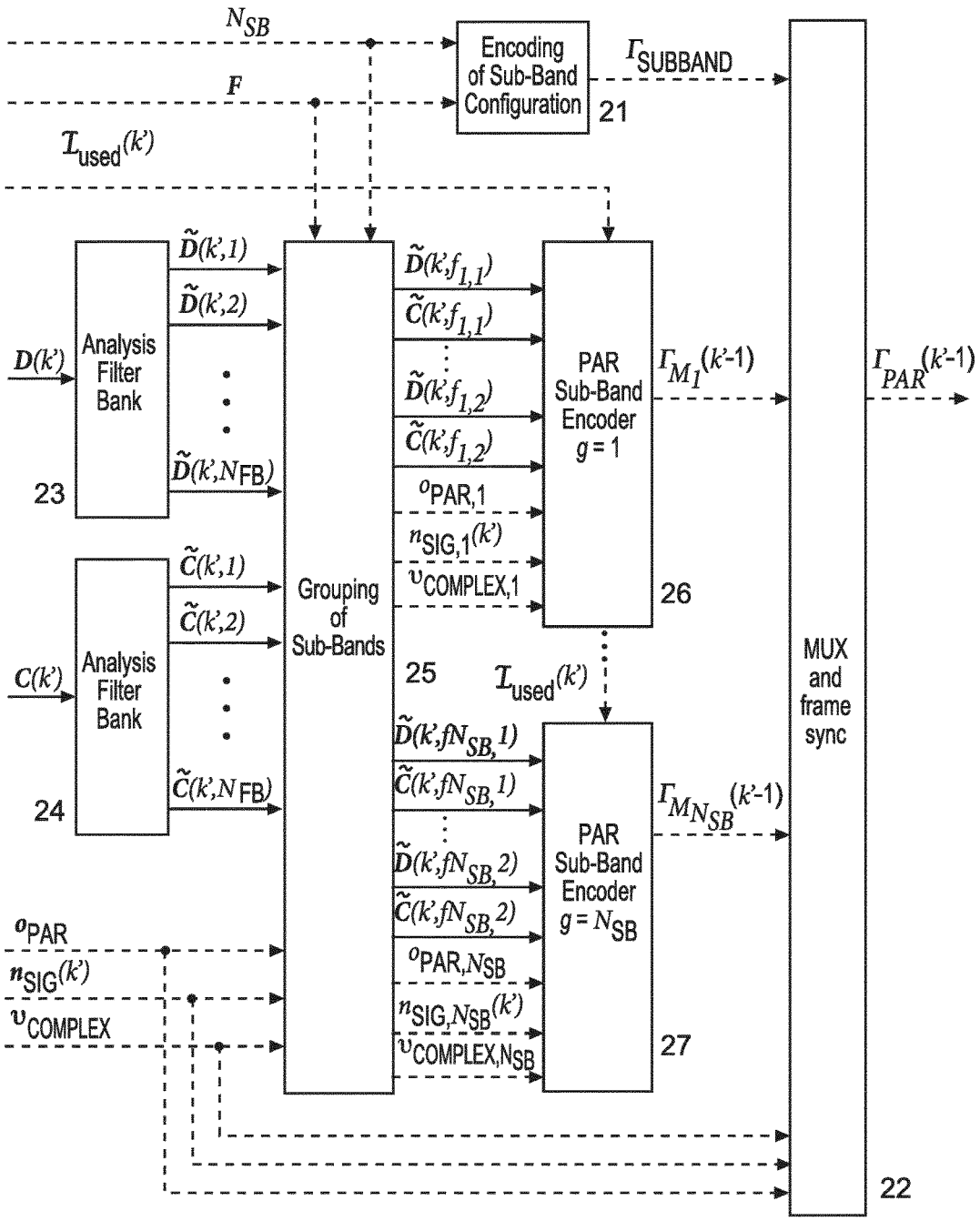
FIG. 2 PAR encoder in more detail, with $k'=k-k_{HOA}$.

A basic feature of the PAR processing is the creation of de-correlated signals from the sparse HOA representation D(k'), and obtaining mixing matrices in the frequency domain that combine these de-correlated signals to a replicated ambient HOA representation that enhances the sparse and highly correlated HOA representation, in order to match the spatial properties of the original HOA representation C(k'). De-correlation means in this context that the phase of the sub-band signals is modified without changing its magnitude. Therefore the PAR encoder shown in FIG. 2 computes from the input HOA representations C(k') and D(k') the coded PAR parameter set $\Gamma_{PAR}(k'-1)$ under consideration of the PAR encoding parameters $o_{PAR}$, $n_{SIG}(k')$, $v_{COMPLEX}$ and $\mathcal{I}_{used}(k')$, wherein index $k'=k-k_{HOA}$ is introduced for simplicity.

The PAR processing is performed in frequency domain. The PAR analysis filter bank transforms the input HOA representation into its complex-valued frequency domain representation, where it is assumed that the number of time domain samples is equal to the number of frequency domain samples. For example, Quadrature Mirror Filter banks (QMF) with $N_{FB}$ sub-bands can be used as filter banks. A first filter bank 24 transforms the O×L matrix C(k') into $N_{FB}$ frequency domain $O\times\tilde{L}$ matrices $\tilde{C}(k',j)$, with $j=1, \ldots, N_{FB}$ and $$\tilde{L}=\frac{L}{N_{FB}},$$

and a second filter bank 23 transforms the O×L matrix D(k') into $N_{FB}$ frequency domain $O\times\tilde{L}$ matrices $\tilde{D}(k',j)$, with $j=1, \ldots, N_{FB}$ and $$\tilde{L}=\frac{L}{N_{FB}}.$$

In step or stage 25, which also receives F, $o_{PAR}$, $n_{SIG}(k')$ and $v_{COMPLEX}$, these sub-bands are grouped into $N_{SB}$ sub-band groups. The signals of each sub-band group $g=1 \ldots N_{SB}$ are encoded individually by a corresponding number of PAR sub-band encoder steps or stages 26 and 27.

The PAR sub-band configuration is defined by the matrix $$F = \begin{bmatrix} f_{1,1} & f_{1,2} \\ \vdots & \vdots \\ f_{N_{SB},1} & f_{N_{SB},2} \end{bmatrix}, \tag{1}$$

where the first and second columns hold the index j of the first and last sub-band index of the corresponding sub-band group g. The sub-band configuration is encoded in step or stage 21 to the parameter set $\Gamma_{SUBBAND}$ by the method described in European patent application EP 14306347.7. Because it is fixed for each frame index k, it has to be transmitted to the decoder only once for initialisation.

The grouping of sub-bands in step/stage 25 directs the input signals and parameters to each PAR sub-band encoder step/stage 26, 27 according to the given sub-band configuration, so that each PAR sub-band encoder of the sub-band group g gets $\tilde{C}(k',j_g)$, $\tilde{D}(k',j_g)$, $o_{PAR,g}$, $n_{SIG,g}(k')$, and $v_{COMPLEX,g}$ as input for all $j_g=f_{g,1}, \ldots, f_{f,2}$.

The parameter $o_{PAR,g}$ indicates the HOA order for which the PAR encoder computes parameters. This order is equal or less than the HOA order N of the HOA representation C(k'). It is used to reduce the data rate for transmitting the encoded PAR parameters $\Gamma_{M_g}(k'-1)$. The vector $$o_{PAR}=[o_{PAR,1}, \ldots, o_{PAR,N_{SB}}]^T \tag{2}$$

holds the HOA orders for all sub-band groups.

The number of de-correlated signals used to create one spatial domain signal of the replicated ambient HOA representation is defined by the vector $$n_{SIG}(k')=[n_{SIG,1}(k'), \ldots, n_{SIG,N_{SB}}(k')]^T, \tag{3}$$

with $0 \le n_{SIG,g}(k') \le (o_{PAR,g}+1)^2$ and $n_{SIG,g}(k') \in \mathbb{N}_0$. It is updated per frame because the number of required signals depends on the HOA representation. For HOA representations comprising highly spatially diffuse scenes, more de-correlated signals are required than for a HOA representation that are less spatially diffuse. Because the data rate for the encoded PAR parameters increases with the used number of de-correlated signals, the parameter can also be used for reducing the data rate.

The mixing of the de-correlated signals is done by a matrix multiplication, where the encoded matrix is included in the PAR parameter set $\Gamma_{M_g}(k'-1)$. The vector $$v_{COMPLEX}=[v_{COMPLEX,1}, \ldots, v_{COMPLEX,N_{SB}}]^T \tag{4}$$

comprises a Boolean variable that indicates whether or not the elements of the mixing matrix are real-valued non-negative or complex-valued numbers, where it can be defined that for $v_{COMPLEX,g}=1$ a matrix of complex-valued elements is used in sub-band group g. Due to the compression of the transport signals Z(k), the phase information of the decoded transport signals might get lost at decoder side due to parametric coding tools (for example in case the spectral band replication method is applied). In this case the PAR processing can only replicate the spatial power distribution of the missing ambience components, which means that the phase information of the PAR mixing matrix is obsolete. Furthermore the parameter $\mathcal{J}_{used}(k')$ is input to each PAR sub-band encoder step/stage 26, 27. This set holds the indexes of the sparse HOA coefficient sequences from D(k') that are used to create de-correlated signals. The indexes should address coefficient sequences within the HOA order $o_{PAR,g}$, which should not differ significantly from the sequences of the original HOA representation C(k'). In the best case the sequences are identical at the PAR encoder so that at decoder side the selected sequences differ only by the distortions added by the perceptual coding.

Finally, the encoded PAR parameter sets $$\Gamma_{M_1}(k'-1), \ldots, \Gamma_{M_{N_{SB}}}(k'-1),$$

the encoded sub-band configuration set $\Gamma_{SUBBAND}$ and the PAR coding parameters $o_{PAR}$, $n_{SIG}(k')$ and $v_{COMPLEX}$ are synchronised by their frame indexes and multiplexed into the PAR bit stream parameter set $\Gamma_{PAR}(k'-1)$ in a multiplexer and frame synchronisation step or stage 22.

PAR Sub-Band Encoder

Figure 3:
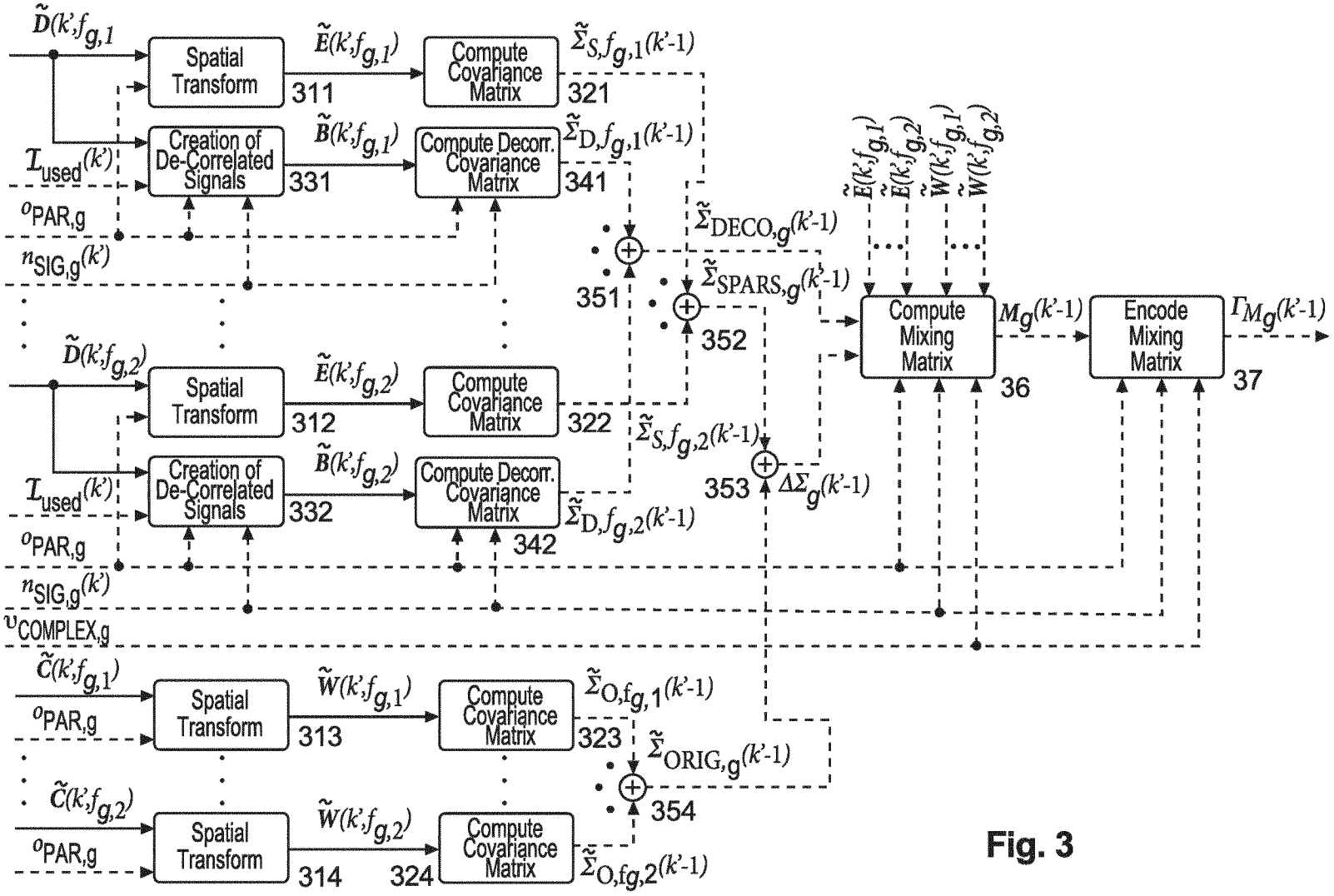
FIG. 3 PAR sub-band encoder.

The PAR sub-band encoder steps/stages 26 and 27 are shown in more detail in FIG. 3. For each sub-band $j_g=f_{g,1}, \ldots, f_{g,2}$ of the PAR sub-band g the matrices $\tilde{C}(k',j_g)$ and $\tilde{D}(k',j_g)$ are transformed in steps or stages 311, 312, 313 to their spatial domain representations $\tilde{W}(k',j_g)$ and $\tilde{E}(k',j_g)$ by a spatial transform that is described below in section Spatial transform. Therefrom in steps or stages 321, 322, 323 and 324 the covariance matrices $$\tilde{\Sigma}_{S,j_g}(k'-1)=\tilde{E}(k',j_g)\tilde{E}(k',j_g)^H+\tilde{E}(k'-1,j_g)\tilde{E}(k-1,j_g)^H \tag{5}$$

and $$\tilde{\Sigma}_{O,j_g}(k'-1)=\tilde{W}(k',j_g)\tilde{W}(k',j_g)^H+\tilde{W}(k'-1,j_g)\tilde{W}(k-1,j_g)^H \tag{6}$$

are computed where $A^H$ denotes the hermitian transposed of a matrix A. The matrices of the previous frame are included in order to obtain covariance matrices that are valid for the current and previous frame for enabling a cross-fade between the matrices of two adjacent frames at the PAR decoder. The creation of de-correlated signals in steps or stages 331 and 332 transforms a sub-set of coefficient sequences from $\tilde{D}(k',j_g)$, which is selected according to the index set of used coefficients $\mathcal{J}_{used}(k')$ to the spatial domain and permutes these spatial domain signals with the permutation matrix $P_{o_{PAR,g},n_{SIG,g}(k'-1)}$ in order to assign the signals to the corresponding de-correlators that create a matrix $\tilde{B}(k',j_g)$. A detailed description of these processing steps is given below in section Creation of de-correlated signals.

For obtaining in steps or stages 341 and 342 the covariance matrix of the corresponding spatial domain signals, the permutation included in $\tilde{B}(k',j_g)$ has to be inverted by the matrix $P^H_{o_{PAR,g},n_{SIG,g}(k'-1)}$. Therefore the covariance matrices of the de-correlated signals are obtained from $$\tilde{\Sigma}_{D,j_g}(k'-1) = P^H_{o_{PAR,g},n_{SIG,g}(k'-1)}\tilde{B}(k',j_g)\tilde{B}(k',j_g)^H P_{o_{PAR,g},n_{SIG,g}(k'-1)} + P^H_{o_{PAR,g},n_{SIG,g}(k'-1)}\tilde{B}(k'-1,j_g)\tilde{B}(k'-1,j_g)^H P_{o_{PAR,g},n_{SIG,g}(k'-1)}. \tag{7, 8}$$

For the computation of $\tilde{\Sigma}_{D,j_g}(k'-1)$ the inverse permutation matrix $P^H_{o_{PAR,g},n_{SIG,g}(k'-1)}$ is applied to the current and the previous frame for obtaining covariance matrices that are valid for both frames. This is required for a valid cross-fade between the mixing matrices and the permutations of two adjacent frames.

It is assumed that the HOA representations of each sub-band are independent of each other, so that the covariance matrix of a sub-band group can be computed by the sum of the covariance matrices of its sub-bands. Accordingly, the PAR sub-band encoder computes the covariance matrix $$\tilde{\Sigma}_{SPARS,g}(k'-1)=\Sigma_{j_g=f_{g,1}}^{f_{g,2}}\tilde{\Sigma}_{S,j_g}(k'-1) \tag{9}$$

in a combiner step or stage 352, the covariance matrix $$\tilde{\Sigma}_{ORIG,g}(k'-1)=\Sigma_{j_g=f_{g,1}}^{f_{g,2}}\tilde{\Sigma}_{O,j_g}(k'-1) \tag{10}$$

in a combiner step or stage 354, and the covariance matrix $$\tilde{\Sigma}_{DECO,g}(k'-1)=\Sigma_{j_g=f_{g,1}}^{f_{g,2}}\tilde{\Sigma}_{D,j_g}(k'-1) \tag{11}$$

in a combiner step or stage 351.

From the covariance matrix of the de-correlated signals $\tilde{\Sigma}_{DECO,g}(k'-1)$, from the matrix $$\Delta\Sigma_g(k'-1)=\tilde{\Sigma}_{ORIG,g}(K'-1)-\tilde{\Sigma}_{SPARS,g}(k'-1) \tag{12}$$

generated in combiner step or stage 353, and from the matrices $\tilde{W}(k',j_g)$ and $\tilde{B}(k',j_g)$ the mixing matrix $M_g(k'-1)$ is obtained by a mixing matrix computing step or stage 36, the processing of which is described in section Computation of the mixing matrix.

Finally in step or stage 37 mixing matrix $M_g(k'-1)$ is quantised and encoded to the parameter set $\Gamma_{M_g}(k'-1)$ as described in section Encoding of the mixing matrix.

Spatial Transform

In the spatial transform the input HOA representation C is transformed to its spatial domain representation W using the spherical harmonic transform from section Definition of real valued Spherical Harmonics for the given HOA order $o_{PAR,g}$. Because the HOA order $o_{PAR,g}$ is usually smaller than the input HOA order N, the rows from C having an index higher than $Q_{PAR,g}=(o_{PAR,g}+1)^2$ have to be removed before the spherical harmonic transform can be applied.

Creation of De-Correlated Signals

The creation of the de-correlated signals includes the following processing steps:

- Select a sub-set of coefficient sequences defined by the index set of used coefficients $\mathcal{J}_{used}(k')$ from the sparse HOA representation $\tilde{D}(k',j_g)$;
- Perform the spatial transform of the selected coefficient sequences according to section Spatial transform for the HOA order $o_{PAR,g}$;
- Permutation of the spatial domain signals for the assignment to the de-correlators by the permutation matrix $P_{o_{PAR,g},n_{SIG,g}}(k')$, which is selected for the number of signals $n_{SIG,g}(k')$ used for the ambience replication and the HOA order $o_{PAR,g}$;
- De-correlate the permuted signals using an individual processing that modifies the phase of the sub-band signals while best preserving the magnitude of the sub-band signals.

In the following a detailed description of these processing steps is given.

The de-correlator removes all inactive HOA coefficient sequences from the input matrix $\tilde{D}(k',j_g)$ by replacing rows that have an index that is not an element of the index set $\mathcal{J}_{used}(k')$ by an $1\times\tilde{L}$ vector of zeros. The resulting matrix $\tilde{D}_{ACT}$ is then transformed to its $Q_{PAR,g}\times\tilde{L}$ spatial domain representation matrix $\tilde{W}_{ACT}$ using the spatial transform from section Spatial transform.

During the computation of each row of the mixing matrix $n_{SIG,g}(k')$ spatially adjacent signals from $\tilde{B}(k',j_g)$ are selected. Therefore the matrix $\tilde{W}_{ACT}$ is permuted for directing the signals from $\tilde{W}_{ACT}$ to the de-correlators, so that the best de-correlation between the $n_{SIG,g}(k')$ selected signals is guaranteed. A fixed $Q_{PAR,g}\times Q_{PAR,g}$ permutation matrix $P_{o_{PAR,g},n_{SIG,g}(k')}$ has to be defined for each predefined combination of $n_{SIG,g}(k')$ and $o_{PAR,g}$ The computation of these permutations matrices and the corresponding signal selection tables are given in section Computation of permutation and selection matrices.

The actual permutation is then performed by $$\tilde{W}_{PERMUTE}=\begin{cases} P_{o_{PAR,g},n_{SIG,g}(k')}\tilde{W}_{ACT} & \text{if } n_{SIG,g}(k')=n_{SIG,g}(k'-1) \\ \left(P_{o_{PAR,g},n_{SIG,g}(k')}\mathrm{diag}(f_{in})+P_{o_{PAR,g},n_{SIG,g}(k'-1)}\mathrm{diag}(f_{out})\right)\tilde{W}_{ACT} & \text{else} \end{cases}, \tag{13}$$

where diag(f) forms a diagonal matrix from the elements of f.

The fade-in and fade-out vectors for the switching between different permutation matrices are defined by $$f_{in}:=[f_{win}(1)f_{win}(2)\ldots f_{win}(\tilde{L})] \tag{14}$$

$$f_{out}:=[f_{win}(\tilde{L}+1)f_{win}(\tilde{L}+2)\ldots f_{win}(2\tilde{L})] \tag{15}$$

and whose elements are obtained from $$f_{win}(l):=\frac{1}{2}\left[1-\cos\left(2\pi\frac{l-1}{2\tilde{L}}\right)\right],\ l=1,\ldots,2\tilde{L}. \tag{16}$$

The fading from one permutation matrix to the other prevents discontinuities in the input signals of the de-correlators. Subsequently the $Q_{PAR,g}$ signals in each row of $\tilde{W}_{PERMUTE}$ are de-correlated by the corresponding de-correlators in order to form the matrix $\tilde{B}(k',j_g)$. The used de-correlation method is defined in the MPEG Surround standard ISO/IEC FDIS 23003-1, MPEG Surround, section 6.6.

Basically each de-correlator delays each frequency band signal by an individual number of samples, where the delay is equal for all $Q_{PAR,g}$ de-correlators. Additionally each of the de-correlators applies an individual all-pass filter to its input signal. The different configurations of the de-correlators distort the phase information of the spatial domain signals $\tilde{W}_{PERMUTE}$ differently, which results in a de-correlation of the spatial domain signals.

Computation of the Mixing Matrix

The mixing matrix $M_g(k'-1)$ can be computed for real-valued non-negative or complex-valued matrix elements which is signalled by the variable $v_{COMPLEX,g}$. For $v_{COMPLEX,g}$ equal to one, the complex-valued mixing matrix is computed according to section Complex-valued mixing matrices, whereby this computation is only applicable if the perceptual coding of the transport channels does not destroy the phase information of the samples in the sub-band group g.

Otherwise a mixing matrix of real-valued non-negative elements is sufficient for the extraction of the replicated ambient HOA representation. An example processing for the computation of the real-valued non-negative mixing matrix is given in section Real-valued non-negative mixing matrices.

Complex-Valued Mixing Matrices

The computation of the mixing matrix is based on the method described in the above-mentioned Vilkamo/Baeckstroem/Kuntz article. A mixing matrix M is computed for up-mixing multi-channel signals X to the signals Y with a higher number of channels by Y=MX. The solution for the mixing matrix M $$\text{satisfying } M=\operatorname{argmin}_{M'\in A}(\|M'X-GQX\|_{FRO}^2) \tag{17}$$

$$\text{with } A=\{M'=\operatorname{argmin}_{M''}\|\Sigma_Y-M''\Sigma_X M''^H\|_2\} \tag{18}$$

$$\text{is given by } M=K_Y V U^H K_X^{-1} \tag{19}$$

$$\text{with } \Sigma_Y=K_Y K_Y^H=YY^H, K_Y\in\mathbb{C}^{Q_{PAR}\times Q_{PAR}} \text{ and } Y\in\mathbb{C}^{Q_{PAR}\times L} \tag{20}$$

$$\Sigma_X=K_X K_X^H=XX^H, K_X\in\mathbb{C}^{Q_{PAR}\times Q_{PAR}} \text{ and } X\in\mathbb{C}^{Q_{PAR}\times L} \tag{21}$$

$$USV^H=K_X^H Q^H G^H K_Y, \tag{22}$$

where $\|\cdot\|_{FRO}$ denotes the Frobenius norm of a matrix, and the signal vector X and the covariance matrix $\Sigma_Y$ of $\hat{Y}$ are known. The prototype mixing matrix Q satisfies $\hat{Y}$=QX so that $\hat{Y}$ is a good approximation of Y. As the energies of the signals from $\hat{Y}$ and Y might differ, the diagonal matrix G normalises the energy of $\hat{Y}$ to the energy of Y where the diagonal elements of G are given by $$g_{ii}=\sqrt{\frac{\sigma_{Y_{ii}}}{\sigma_{\hat{Y}_{ii}}}} \tag{23}$$

and $\sigma_{Y_{ii}}$ and $\sigma_{\hat{Y}_{ii}}$ are the diagonal elements of $\Sigma_Y$ and $\Sigma_{\hat{Y}}=\hat{Y}\hat{Y}^H$. Each sub-band $j_g=f_{g,1}, \ldots, f_{g,2}$ of the g-th sub-band group the matrix $C_{out}(\{k',k'-1\},j_g)$ of the enhanced spatial domain signals is assumed to be computed from the sum of the spatial domain signals of the sparse HOA representation and the mixed spatial domain de-correlated signals by $$C_{out}(\{k',k'-1\},j_g)=\tilde{E}(\{k',k-1\},j_g)+M_g(k'-1)\tilde{B}(\{k',k'-1\},j_g), \tag{24}$$

where the notation $\{k',k'-1\}$ is used to express that the mixing matrix $M_g(k'-1)$ is valid for the current and the previous frame.

Since the spatial domain signals $\tilde{E}(\{k',k'-1\},j_g)$ and $\tilde{B}(\{k',k'-1\},j_g)$ are assumed to be uncorrelated per definition, the correlation matrix $\Sigma_{out}(k'-1)$ of the enhanced spatial domain signals $C_{out}(\{k',k'-1\},j_g)$ can be written as the sum of the correlation matrices of the two components by $$\Sigma_{out}(k'-1)=\tilde{\Sigma}_{SPARS,g}(k'+1)+M_g(k'+1)\tilde{\Sigma}_{DECO,g}(k'-1)M_g(k'-1)^H. \tag{25}$$

In order to make the enhanced sparse HOA representation sound like the original HOA representation $\tilde{C}(k',j_g)$ from a psycho-acoustic perspective, their correlation matrices can be matched, i.e.

$$\Sigma_{out}(k'-1)\overset{!}{=}\tilde{\Sigma}_{ORIG,g}(k'-1). \tag{26}$$

This requirement leads to the following constraint of the mixing matrix:

$$\Delta\Sigma_g(k-1)\overset{!}{=}M_g(k'-1)\tilde{\Sigma}_{DECO,g}(k'-1)M_g(k'-1)^H, \tag{27}$$

where $\Delta\Sigma_g(k'-1)$ is defined in equation (12).

The comparison of equations (18) and (27) results in the assignments $$\Sigma_Y:=\Delta\Sigma_g(k'-1) \tag{28}$$

$$\Sigma_X:=\tilde{\Sigma}_{DECO,g}(k'-1) \tag{29}$$

$$X:=\tilde{B}(\{k',k'-1\},j_g) \tag{30}$$

$$Y:=\tilde{W}(\{k',k'-1\},j_g)-\tilde{E}(\{k',k-1\},j_g), \tag{31}$$

where $K_Y$ and $K_X$ can be computed from the singular value decomposition of $\Delta\Sigma_g(k'-1)$ and $\tilde{\Sigma}_{DECO,g}(k'-1)$.

Finally a matrix Q has to be defined for the proposed method. Because matrix $\hat{Y}$ should be a good approximation of Y, Q has to solve the equation $$\tilde{W}(\{k',k'-1\},j_g)-\tilde{\Sigma}(\{k',k'-1\},j_g)\overset{!}{=}Q\tilde{B}(\{k',k'-1\},j_g) \text{ for all } j_g=f_{g,1}f_{g,2}. \tag{32}$$

A well-known solution for this problem is to minimise the Euclidean norm of the approximation error defined as $$Q_g=\operatorname{argmin}_{Q'}\left(\sum_{j_g=f_{g,1}}^{f_{g,2}}\left\|\tilde{W}(\{k',k'-1\},j_g)-\tilde{E}(\{k',k'-1\},j_g)-Q'\tilde{B}(\{k',k'-1\},j_g)\right\|_2^2\right) \tag{33}$$

by using the Moore-Penrose pseudoinverse.

For the reduction of the data rate for transmitting the mixing matrix, $n_{SIG,g}(k'-1)$ spatially adjacent signals from $\tilde{B}(\{k',k'-1\},j_g)$ can be selected for the computation of each spatial domain signal of the replicated ambient HOA representation. Hence each row of the mixing matrix $M_g(k'-1)$ has to be computed individually according to the selection matrix $$S_{n_{SIG,g}(k'-1)}^{(o_{PAR,g})}=\begin{bmatrix} s_{1,1} & \cdots & s_{1,n_{SIG,g}(k'-1)} \\ \vdots & \ddots & \vdots \\ s_{Q_{PAR,g},1} & \cdots & s_{Q_{PAR,g},n_{SIG,g}(k'-1)} \end{bmatrix} \tag{34}$$

where the elements $s_{o,n}$ denote the indexes of the row vectors from $\tilde{B}(\{k',k'-1\},j_g)$ that are used to create the o-th spatial domain signal of the replicated ambient HOA representation with $n=1 \ldots n_{SIG,g}(k'-1)$. To solve equation (19) individually for each row of the mixing matrix, it has to be transformed to $$P^{-H}K_X^H M^H=K_Y^H, \tag{35}$$

$$\text{with } P=VU^H. \text{ It is defined that } T:=P^{-H}K_X^H \tag{36}$$

and $t_a$ is one of the $a=1 \ldots Q_{PAR,g}$ column vectors of T. For the computation of each of the $o=1 \ldots Q_{PAR,g}$ rows of $M_g(k'-1)$, the sub-matrix $$T_o=\left[t_{s_{o,1}}, \ldots, t_{s_{o,n_{SIG,g}(k'-1)}}\right] \tag{37}$$

is built and the vector $m_{row,o}$ is determined by $$m_{row,o}=T_o^+ k_{Y,o}^H \tag{38}$$

where $k_{Y,o}$ is the o-th row vector from $K_Y$ and $T_o^+$ denotes the Moore-Penrose pseudoinverse. In some cases $T_o$ can be ill-conditioned which might require a regularisation in the computation of the pseudoinverse.

At least the elements $m_{o,i}$ of the mixing matrix $M_g(k'-1)$ are assigned to $$m_{o,b}=\begin{cases} m_{row,o,a} & \text{if } \exists a \text{ s.t. } s_{o,a}=b \\ 0 & \text{else} \end{cases}, \tag{39}$$

where $m_{row,o,a}$ are the elements of the vector $m_{row,o}$ and $o=1 \ldots Q_{PAR,g}$.

Real-Valued Non-Negative Mixing Matrices

However, for high-frequency sub-band groups g which might be affected by the spectral bandwidth replication of the perceptual coding, the method described in section Complex-valued mixing matrices is not reasonable because the phases of the reconstructed sub-band signals of the sparse HOA representation cannot be assumed to even rudimentary resemble that of the original sub-band signals.

For such cases the phases can be disregarded. Instead, one concentrates only on the signal powers for the computation of the mixing matrices $M_g(k'-1)$. A reasonable criterion for the determination of the prediction coefficients is to minimise the error $$|\tilde{W}(\{k',k'-1\},j_g)-\tilde{E}(\{k',k'-1\},j_g)|^2-|M_g(k'-1)|^2|\tilde{B}(\{k',k'-1\},j_g)|^2 \tag{40}$$

where the operation $|\cdot|^2$ is assumed to be applied element-wise to the matrices. In other words, the mixing matrix is chosen such that the sum of the powers of all weighted spatial sub-band signals of the de-correlated HOA representation best approximates the power of the residuum of the original and the spatial domain sub-band signals of the sparse HOA representation. In this case, Nonnegative Matrix Factorisation (NMF) techniques can be used to solve this optimisation problem. For an introduction to NMF, see e.g. D. D. Lee, H. S. Seung, "Learning the parts of objects by nonnegative matrix factorization", Nature, vol. 401, pages 788-791, 1999.

Encoding of the Mixing Matrix

The mixing matrix $M_g(k'-1)$ of each sub-band group $g=1, \ldots, N_{SB}$ is to be quantised and encoded to the parameter set $\Gamma_{M_g}(k'-1)$, where only a $Q_{PAR,g} \times n_{SIG,g}(k'-1)$ sub-matrix defined by the selection matrix $S_{n_{SIG,g}(k'-1)}^{(o_{PAR,g})}$. The quantisation of the matrix elements has to reduce the data rate without decreasing the perceived audio quality of the replicated ambient HOA representation. Therefore the fact can be exploited that, due to the computation of the covariance matrices on overlapping frames, there is a high correlation between the mixing matrices of successive frames. In particular, each sub-matrix element can be represented by its magnitude and its angle, and then the differences of angles and magnitudes between successive frames are coded.

If it is assumed that the magnitude lies within the interval $[0,m_{max}]$ the magnitude difference lies within the interval $[-m_{max},m_{max}]$ The difference of angles is assumed to lie within the interval $[-\pi,\pi]$. For the quantisation of these differences predefined numbers of bits for the magnitude and angle difference are used correspondingly. In the case of using mixing matrices with real-valued non-negative elements, only the magnitude differences are coded because the phase difference is always zero.

The inventors have found experimentally that the occurrence probabilities of the individual differences are distributed in a highly non-uniform manner. In particular, small differences in the magnitudes as well as in the angles occur significantly more frequently than big ones. Hence, a coding method (like Huffman coding) that is based on the a-priori probabilities of the individual values to be coded can be exploited in order to reduce significantly the average number of bits per mixing matrix element.

Additionally the value of $n_{SIG,g}(k'-1)$ has to be transmitted per frame. An index of a predefined table can be signalled for this purpose, which index is defined for each valid PAR HOA order.

Computation of Permutation and Selection Matrices

To reduce the data rate for the transmission of the mixing matrices, the number of active (i.e. non-zero) elements per row can be reduced. The active row elements correspond to $n_{SIG}$ of $Q_{PAR}$ de-correlated signals in the spatial domain that are used for mixing one spatial domain signal of the replicated ambient HOA representation, which is now called target signal. The complex-valued sub-band signals of the de-correlated spatial domain signals to be mixed should ideally have a scaled magnitude spectrum as the target signal, but different phase spectra. This can be achieved by selecting the signals to be mixed from the spatial vicinity of the target signal.

Thus, in a first step for each o-th target signal position, $o=1, \ldots, Q_{PAR}$, groups of $n_{SIG}$ spatially adjacent positions have to be found for each HOA order $o_{PAR}$ and for each number of active rows $n_{SIG}$. In a second step, the assignment of the $Q_{PAR}$ input signals to the $Q_{PAR}$ de-correlators is obtained in order to minimise the mutual correlation between the $n_{SIG}$ signals in each group.

One way to find the $n_{SIG}$ signals of a group for a given HOA order $o_{PAR}$ is to compute the angular distance between all spatial domain positions and the position of the o-th target signal, and to select the signal indexes belonging to the $n_{SIG}$ smallest distances into the o-th group. Thus the o-th row vector of the matrix $S_{n_{SIG}}^{(o_{PAR})}$ from equation (34) consists of the ascendingly sorted indexes of the o-th group. The matrices for each predefined combination of $o_{PAR}$ and $n_{SIG}$ are assumed to be known in the PAR encoder and decoder.

Now the assignment of the spatial domain signals to the de-correlators has to be found and stored in the permutation matrix $P_{o_{PAR},n_{SIG}}$ for each predefined combination of $o_{PAR}$ and $n_{SIG}$. Therefore a search over all possible assignments is applied in order to find the best assignment under a certain criterion. One possible criterion is to build the covariance matrix $\Sigma$ of the all-pass impulse responses of all de-correlators. The penalty of an assignment is computed by the following steps:

- Build for each group a covariance sub-matrix by selecting only the elements from matrix $\Sigma$ that are assigned to the signals of the group;
- Sum the quotient of the maximum and the minimum singular value of each covariance sub-matrix.

From the assignment with the lowest penalty the permutation matrix $P_{o_{PAR},n_{SIG}}$ is obtained, so that each row of the matrix $\tilde{W}_{ACT}$ from section Creation of de-correlated signals is permuted to the corresponding index of the assigned de-correlator.

HOA Decoder Framework

Figure 4:
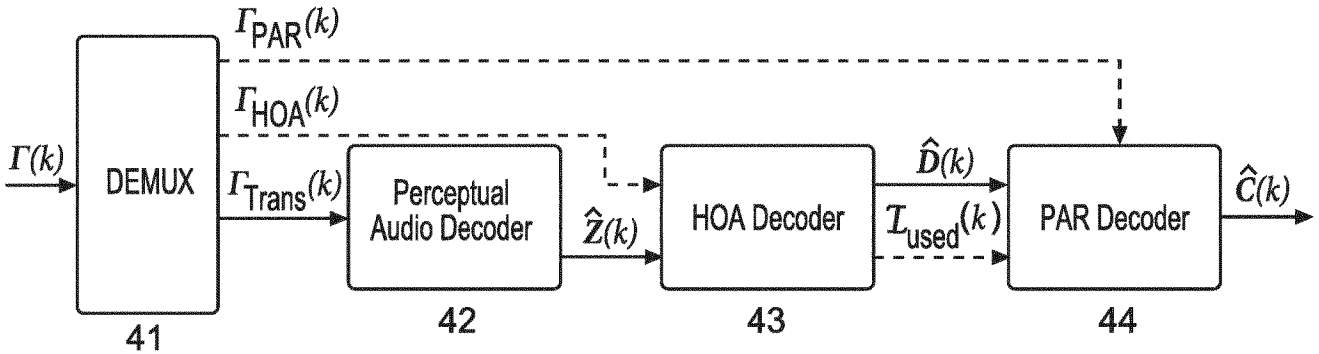
FIG. 4 HOA data decompressor including a PAR decoder.

The framework of the HOA decoder/HOA decompressor including the PAR decoder is depicted in FIG. 4. The bit steam parameter set $\Gamma(k)$ is de-multiplexed in a demultiplexer step or stage 41 into the side information parameter sets $\Gamma_{HOA}(k)$ and $\Gamma_{PAR}(k)$, and the signal parameter set $\Gamma_{Trans}(k)$. Because the delay between the side information and the signal parameters has already been aligned in the HOA encoder, the decoder side receives its data already synchronised.

The signal parameter set $\Gamma_{Trans}(k)$ is fed to a perceptual audio decoder step or stage 42 that decodes the sparse HOA representation $\hat{Z}(k)$ from the signal parameter set $\Gamma_{Trans}(k)$ following HOA decoder step or stage 43 composes the decoded sparse HOA representation $\hat{D}(k)$ from the decoded transport signals $\hat{Z}(k)$ and the side information parameter set $\Gamma_{HOA}(k)$. The index set $\mathcal{J}_{used}(k)$ is also reconstructed by the HOA decoder step/stage 43. The decoded sparse HOA representation $\hat{D}(k)$, the index set $\mathcal{J}_{used}(k)$ and the PAR side information parameter set $\gamma_{PAR}(k)$ are fed to a PAR decoder step or stage 44, which reconstructs therefrom the replicated ambient HOA representation and enhances the decoded sparse HOA representation $\hat{D}(k)$ to the decoded HOA representation $\hat{C}(k)$.

PAR Decoder Framework

Figure 5:
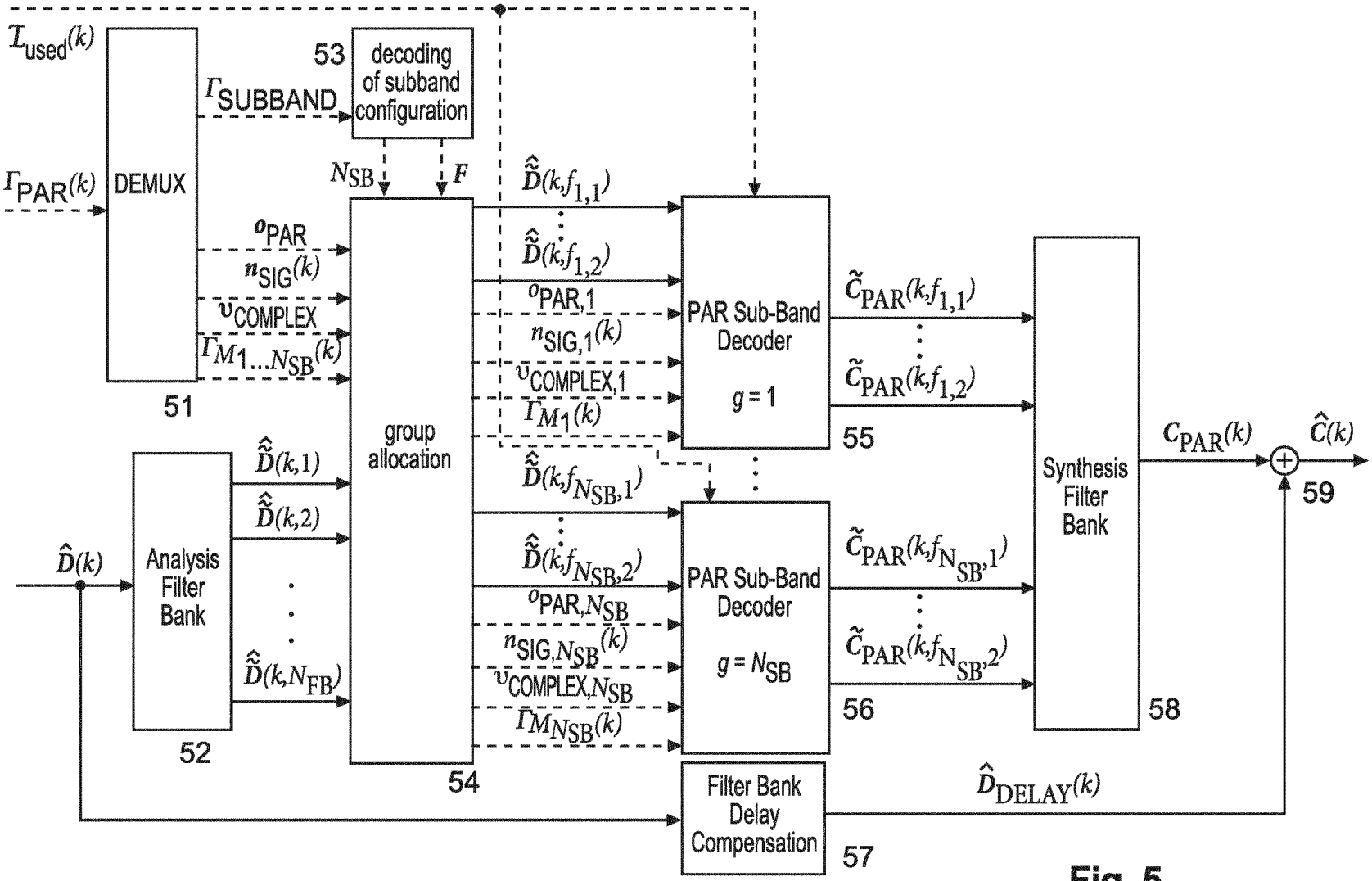
FIG. 5 PAR decoder in more detail.

The PAR decoder framework shown in FIG. 5 enhances the decoded sparse HOA representation $\hat{D}(k)$ by the decoded replicated ambient HOA representation $C_{PAR}(k)$ in order to reconstruct the decoded HOA representation $\hat{C}(k)$. The samples of the decoded HOA representation $\hat{C}(k)$ are delayed according to the analysis and synthesis delays of the applied filter banks. The PAR side information parameter set $\Gamma_{PAR}(k)$ is de-multiplexed in a demultiplexer step or stage 51 into the sub-band configuration set $F_{SUBBAND}$, the PAR parameters $o_{PAR}$, $n_{SIG}(k)$ $v_{COMPLEX}$, and the data sets of the encoded mixing matrices $\Gamma_{M_g}(k)$ for each sub-band group $g=1, \ldots, N_{SB}$.

In parallel the decoded sparse HOA representation $\hat{D}(k)$ is converted in an analysis filter bank step or stage 52 into $j=1, \ldots, N_{FB}$ frequency-band HOA representation matrices $\hat{\tilde{\boldsymbol{D}}}(k,j)$. The applied filter-bank has to be identical to the one that has been used in the PAR encoder at encoder side.

From the set of sub-band configurations $\Gamma_{SUBBAND}$ the number of sub-band groups $N_{SB}$ and the sub-band configuration matrix F, as defined in equation (1), is decoded in step or stage 53, and is fed into a group allocation step or stage 54. According to these parameters the group allocation step or stage 54 directs the parameters from steps/stages 51 and 53 and the frequency-band HOA representations $\hat{\tilde{\boldsymbol{D}}}(k,j)$ from step/stage 52 to the corresponding PAR sub-band decoder steps or stages 55, 56 for sub-bands $1 \ldots N_{SB}$.

The $N_{SB}$ PAR sub-band decoders 55, 56 create the coefficient sequences of the replicated ambient HOA representation $\tilde{C}_{PAR}(k,j_g)$ from the coefficient sequences of the decoded sparse HOA representation matrices $\hat{\tilde{\boldsymbol{D}}}(k,j_g)$ and the PAR sub-band parameters $o_{PAR}$, $v_{COMPLEX}$, $n_{SIG}(k)$ $\Gamma_{M_g}(k)$ and $\mathcal{J}_{used}(k)$ for the corresponding frequency-bands $j_g=f_{g,1}, \ldots, f_{g,2}$.

The resulting replicated ambient HOA representation matrices $\tilde{C}_{PAR}(k,j)$ of each frequency-band are transformed to the time domain HOA representation $C_{PAR}(k)$ in a synthesis filter bank step or stage 58. Finally $C_{PAR}(k)$ is in a combining step or stage 59 sample-wise added to the delay compensated (in filter bank delay compensation 57) sparse HOA representation $\hat{D}_{DELAY}(k)$, so as to create the decoded HOA representation $\hat{C}(k)$.

PAR Sub-Band Decoder

Figure 6:
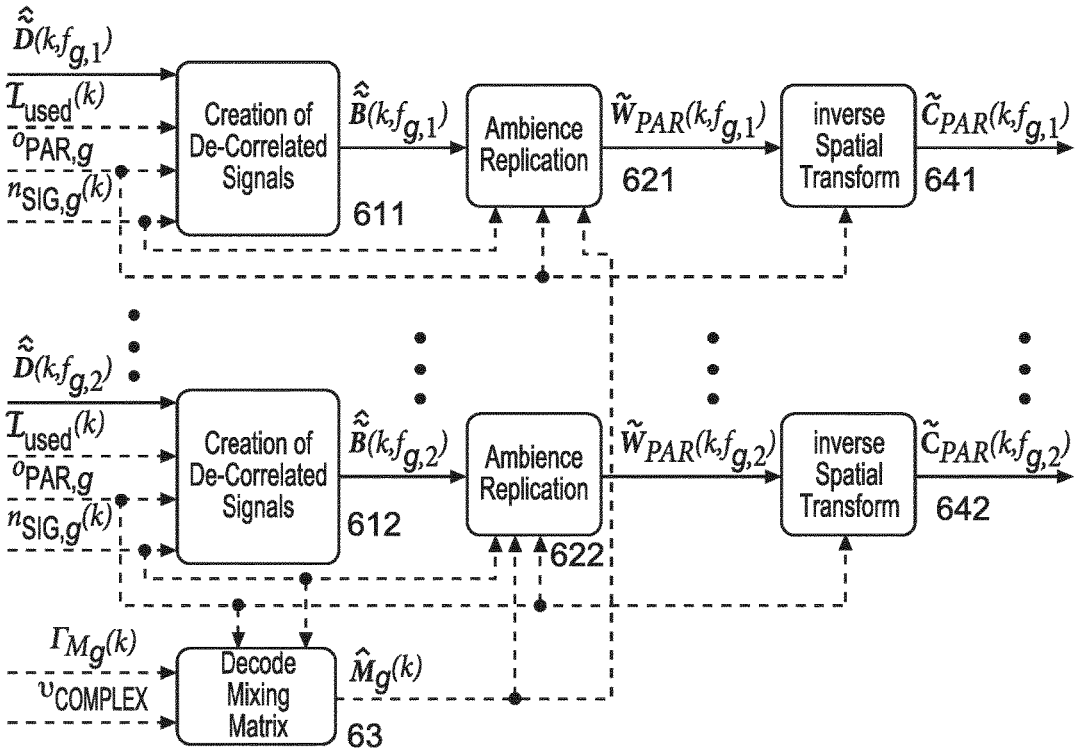
FIG. 6 PAR sub-band decoder.

The PAR sub-band decoder depicted in FIG. 6 creates the frequency domain replicated ambient HOA representation matrices $\tilde{C}_{PAR}(k,j_g)$ for the frequency-bands $j_g=f_{g,1}, \ldots, f_{g,2}$ of a sub-band group g.

In parallel the permuted and de-correlated spatial domain signal matrices $\tilde{B}(g,j_g)$ are generated in steps or stages 611, 612 from the coefficients sequences of the sparse HOA representation matrices $\hat{\tilde{\boldsymbol{D}}}(g,j_g)$ using the parameters $\mathcal{J}_{used}(k)$, $o_{PAR,g}$ and $n_{SIG,g}(k)$, where the processing is identical to the processing from section Creation of de-correlated signals used in the PAR sub-band encoder.

Further, the mixing matrix $\hat{M}_g(k)$ is obtained in mixing matrix decoding step or stage 63 from the data set of the encoded mixing matrix $\Gamma_{M_g}(k)$ using the parameters $o_{PAR,g}$, $n_{SIG,g}(k)$ and $v_{COMPLEX,g}$. The actual decoding of the mixing matrix elements is described in section Decoding of mixing matrix. Subsequently the spatial domain signals of the replicated ambient HOA representation $\tilde{W}_{PAR}(k,j_g)$ are generated in ambience replication steps or stages 621, 622 from the corresponding de-correlated spatial domain signals $\hat{\tilde{\boldsymbol{B}}}(k,j_g)$, using $o_{PAR,g}$, $n_{SIG,g}(k)$ and $\hat{M}_g(k)$, by the ambience replication processing described in section Ambience replication for each frequency band $j_g$ of the sub-band group g.

Finally the spatial domain signals of the replicated ambient HOA representation $\tilde{W}_{PAR}(k,j_g)$ are transformed back in steps or stages 641, 642 to their HOA representation using $o_{PAR,g}$ and the inverse spatial transform, where the inverse spherical harmonic transform from section Spherical Harmonic transform is applied. The created replicated ambient HOA representation matrix $\tilde{C}_{PAR}(k,j_g)$ must have the dimensions $N \times \tilde{L}$ where only the first $Q_{PAR,g}$ rows of the corresponding PAR HOA order $o_{PAR,g}$ have non-zero elements.

Decoding of the Mixing Matrix

The indexes of the elements of the encoded mixing matrix are defined by the current selection matrix $S_{n_{SIG,g}(k)}^{(o_{PAR,g})}$, so that $Q_{PAR,g}$ times $n_{SIG,g}(k)$ elements per mixing matrix have to be decoded.

Therefore in a first step the angular and magnitude differences of each matrix element are decoded according to the corresponding entropy encoding applied in the PAR encoder. Then the decoded angle and magnitude differences are added to the reconstructed $Q_{PAR,g} \times Q_{PAR,g}$ angle and magnitude mixing matrices of the previous frame, where only the elements from the current selection matrix $S_{n_{SIG,g}(k)}^{(o_{PAR,g})}$ are used and all other elements have to be set to zero. From the updated reconstructed angle and magnitude mixing matrices the complex values of the decoded mixing matrix $\hat{M}_g(k)$ are restored by $$m_{a,b}=m_{ABS,a,b}\cdot e^{i m_{ANGLE,a,b}} \text{ with } a=1, \ldots, Q_{PAR,g}, b=1, \ldots, Q_{PAR,g}, \tag{41}$$

where $m_{a,b}$ is the element of $\hat{M}_g(k)$ in the a-th row and in the b-th column, $m_{ANGLE,a,b}$ and $m_{ABS,a,b}$ are the corresponding elements of the updated reconstructed angle and magnitude mixing matrices.

Ambience Replication

The ambience replication performs an inverse permutation of the de-correlated spatial domain signals, which is defined by the permutation matrix for the parameters $o_{PAR,g}$ and $n_{SIG,g}(k)$, followed by a multiplication by the mixing matrix $\hat{M}_g(k)$. For a smooth transition of the parameters of adjacent frames, the de-correlated signals from the current frame are processed and cross-faded using the parameters of the current and the previous frame. The processing of the ambience replication is therefore defined by $$\tilde{W}_{PAR}(k, j_g) = \left(\mathrm{diag}(f_{in})\hat{M}_g(k)P^H_{o_{PAR,g},n_{SIG,g}(k)} + \mathrm{diag}(f_{out})\hat{M}_g(k-1)P^H_{o_{PAR,g},n_{SIG,g}(k-1)}\right)\hat{\tilde{B}}(k, j_g), \tag{42}$$

where the cross-fade function from equations (14) and (15) are used.

Basics of Higher Order Ambisonics

Figure 7:
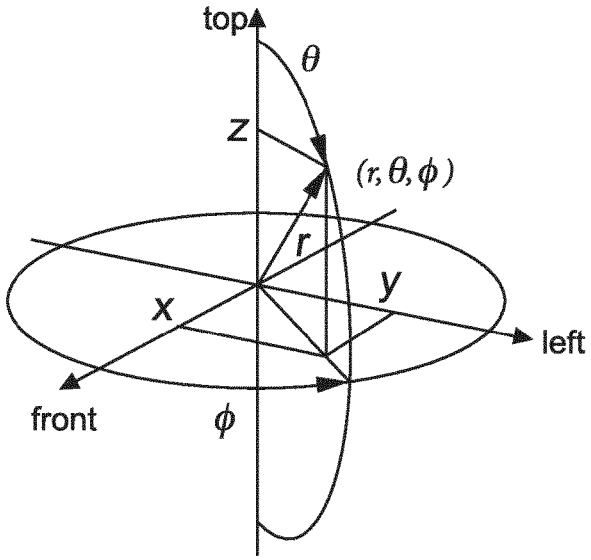
FIG. 7 spherical coordinate system.

Higher Order Ambisonics (HOA) is based on the description of a sound field within a compact area of interest, which is assumed to be free of sound sources. In that case the spatiotemporal behaviour of the sound pressure p(t,x) at time t and position x within the area of interest is physically fully determined by the homogeneous wave equation. In the following a spherical coordinate system as shown in FIG. 7 is assumed. In the used coordinate system the x axis points to the frontal position, the y axis points to the left, and the z axis points to the top. A position in space $x=(r,\theta,\phi)^T$ is represented by a radius $r>0$ (i.e. the distance to the coordinate origin), an inclination angle $\theta \in [0,\pi]$ measured from the polar axis z and an azimuth angle $\phi \in [0,2\pi]$ measured counter-clockwise in the x-y plane from the x axis. Further, $(\cdot)^T$ denotes the transposition.

Then, it can be shown from the "Fourier Acoustics" text book that the Fourier transform of the sound pressure with respect to time denoted by $\mathcal{F}_t(\cdot)$, i.e.

$$P(\omega,x)=\mathcal{F}_t(p(t,x))=\int_{-\infty}^{\infty}p(t,x)e^{-i\omega t}dt \tag{43}$$

with $\omega$ denoting the angular frequency and i indicating the imaginary unit, may be expanded into the series of Spherical Harmonics according to $$P(\omega=kc_s,r,\theta,\phi)=\Sigma_{n=0}^{N}\Sigma_{m=-n}^{n}A_n^m(k)j_n(kr)S_n^m(\theta,\phi), \tag{44}$$

wherein $c_s$ denotes the speed of sound and k denotes the angular wave number, which is related to the angular frequency $\omega$ by $$k=\frac{\omega}{c_s}.$$

Further, $j_n(\cdot)$ denote the spherical Bessel functions of the first kind and $S_n^m(\theta,\phi)$ denote the real valued Spherical Harmonics of order n and degree m, which are defined in section Definition of real valued Spherical Harmonics. The expansion coefficients $A_n^m(k)$ only depend on the angular wave number k. Note that it has been implicitly assumed that the sound pressure is spatially band-limited. Thus the series is truncated with respect to the order index n at an upper limit N, which is called the order of the HOA representation. If the sound field is represented by a superposition of an infinite number of harmonic plane waves of different angular frequencies $\omega$ arriving from all possible directions specified by the angle tuple $(\theta,\phi)$, it can be shown (see B. Rafaely, "Plane-wave decomposition of the sound field on a sphere by spherical convolution", J. Acoust. Soc. Am., vol. 4(116), pages 2149-2157, October 2004) that the respective plane wave complex amplitude function $C(\omega,\theta,\phi)$ can be expressed by the following Spherical Harmonics expansion $$C(\omega=kc_s,\theta,\phi)=\Sigma_{n=0}^{N}\Sigma_{m=-n}^{n}C_n^m(k)S_n^m(\theta,\phi), \tag{45}$$

where the expansion coefficients $C_n^m(k)$ are related to the expansion coefficients $A_n^m(k)$ by $$A_n^m(k)=i^nC_n^m(k). \tag{46}$$

Assuming the individual coefficients $C_n^m(k=\omega/c_s)$ to be functions of the angular frequency $\omega$, the application of the inverse Fourier transform (denoted by $\mathcal{F}^{-1}(\cdot)$) provides time domain functions $$c_n^m(t)=\mathcal{F}_t^{-1}(C_n^m(\omega/c_s))=\frac{1}{2\pi}\int_{-\infty}^{\infty}C_n^m\left(\frac{\omega}{c_s}\right)e^{i\omega t}d\omega \tag{47}$$

for each order n and degree m. These time domain functions are referred to as continuous-time HOA coefficient sequences here, which can be collected in a single vector c(t) by $$c(t)=[\,c_0^0(t)\;\;c_1^{-1}(t)\;\;c_1^0(t)\;\;c_1^1(t)\;\;c_2^{-2}(t)\;\;c_2^{-1}(t)\;\;c_2^0(t)\;\;c_2^1(t)\;\;c_2^2(t)\;\;\ldots\;\;c_N^{N-1}(t)\;\;c_N^N(t)\,]^T \tag{48}$$

The position index of an HOA coefficient sequence $c_n^m(t)$ within vector c(t) is given by n(n+1)+1+m. The overall number of elements in vector c(t) is given by $O=(N+1)^2$.

The final Ambisonics format provides the sampled version of c(t) using a sampling frequency $f_S$ as $$\{c(lT_S)\}_{l\in\mathbb{N}}=\{c(T_S),c(2T_S),c(3T_S),c(4T_S),\ldots\} \tag{49}$$

where $T_S=1/f_S$ denotes the sampling period. The elements of $c(lT_S)$ are referred to as discrete-time HOA coefficient sequences, which can be shown to always be real-valued. This property also holds for the continuous-time versions $c_n^m(t)$.

Definition of Real Valued Spherical Harmonics

The real-valued spherical harmonics $S_n^m(\theta,\phi)$ (assuming SN3D normalisation according to J. Daniel, "Représentation de champs acoustiques, application à la transmission et à la reproduction de scènes sonores complexes dans un contexte multimédia", PhD thesis, Université Paris, 6, 2001, chapter 3.1) are given by $$S_n^m(\theta,\phi)=\sqrt{(2n+1)\frac{(n-|m|)!}{(n+|m|)!}}\,P_{n,|m|}(\cos\theta)trg_m(\phi) \tag{50}$$

with $$trg_m(\phi)=\begin{cases}\sqrt{2}\cos(m\phi) & m>0\\ 1 & m=0\\ -\sqrt{2}\sin(m\phi) & m<0\end{cases}. \tag{51}$$

The associated Legendre functions $P_{n,m}(x)$ are defined as $$P_{n,m}(x)=(1-x^2)^{m/2}\frac{d^m}{dx^m}P_n(x),\ m\geq 0 \tag{52}$$

with the Legendre polynomial $P_n(x)$ and, unlike in E. G. Williams, "Fourier Acoustics", vol. 93 of Applied Mathematical Sciences, Academic Press, 1999, without the Condon-Shortley phase term $(-1)^m$.

Spherical Harmonic Transform

If the spatial representation of an HOA sequence is discretised at a number of O spatial directions $\Omega_o$, $1\leq o\leq O$, which are nearly uniformly distributed on the unit sphere, O directional signals $c(t,\Omega_o)$ are obtained. Collecting these signals into a vector as $$c_{SPAT}(t):=[c(t,\Omega_1)\ldots c(t,\Omega_O)]^T, \tag{53}$$

it can be computed from the continuous Ambisonics representation c(t) defined in equation (48) by a simple matrix multiplication as $$c_{SPAT}(t)=\Psi^Hc(t), \tag{54}$$

where $(\cdot)^H$ indicates the joint transposition and conjugation, and $\Psi$ denotes a mode-matrix defined by $$\Psi:=[S_1\ldots S_O] \tag{55}$$

with $$S_O:=[S_0^0(\Omega_O)S_1^{-1}(\Omega_o)_1^0(\Omega_O)S_1^1(\Omega_O)\ldots S_N^{N-1}(\Omega_O)\;S_N^N(\Omega_O)]. \tag{56}$$

Since the directions $\Omega_O$ are nearly uniformly distributed on the unit sphere, the mode matrix is invertible in general. Hence, the continuous Ambisonics representation can be computed from the directional signals $c(t,\Omega_o)$ by $$c(t)=\Psi^{-H}c_{SPAT}(t). \tag{57}$$

Both equations constitute a transform and an inverse transform between the Ambisonics representation and the spatial domain. These transforms are called the Spherical Harmonic Transform and the inverse Spherical Harmonic Transform. Because the directions $\Omega_O$ are nearly uniformly distributed on the unit sphere, the approximation $$\Psi^H \approx \Psi^{-1} \tag{58}$$

is available, which justifies the use of $\Psi^{-1}$ instead of $\Psi^H$ in equation (54). Advantageously, all the mentioned relations are valid for the discrete-time domain, too.

The described processing can be carried out by a single processor or electronic circuit, or by several processors or electronic circuits operating in parallel and/or operating on different parts of the complete processing.

The instructions for operating the processor or the processors according to the described processing can be stored in one or more memories. The at least one processor is configured to carry out these instructions.

The invention claimed is:

1. A method for improving a low bit rate compressed and decompressed Higher Order Ambisonics HOA signal representation (C(k)) of a sound field, so as to provide a Parametric Ambience Replication parameter set ($\Gamma_{PAR}(k'-1)$), wherein said decompression provides a spatially sparse decoded HOA representation (D(k')) and a set of indices ($\mathcal{J}_{used}(k')$) of coefficient sequences of this representation, said method including:

transforming said spatially sparse decoded HOA representation (D(k')) into a number ($N_{FB}$) of complex-valued frequency domain sub-band representations ($\tilde{D}(k',j)$) and transforming using an analysis filter bank a correspondingly delayed version of said HOA signal representation (C(k')) into a corresponding number ($N_{FB}$) of complex-valued frequency domain sub-band representations ($\tilde{C}(k',j)$);

grouping said sub-bands representations ($\tilde{D}(k',j)$) into a number ($N_{SB}$) of sub-band groups, and within each of these sub-band groups:

creating, using de-correlation filters, for each sub-band in a sub-band group from said complex-valued frequency domain sub-band representation ($\tilde{D}(k',j_g)$) a number of modified phase spectra signals ($\tilde{B}(k',j_g)$) which are uncorrelated with said complex-valued frequency domain sub-band representation ($\tilde{D}(k',j_g)$);

computing for each sub-band in the sub-band group from said modified phase spectra signals ($\tilde{B}(k',j_g)$) a decorrelation covariance matrix;

transforming for each sub-band in the sub-band group said complex-valued frequency domain sub-band representation ($\tilde{D}(k',j_g)$) into its spatial domain representation ($\tilde{E}(k',j_g)$) and computing therefrom a corresponding covariance matrix;

transforming for each sub-band in the sub-band group a complex-valued frequency domain sub-band representation ($\tilde{C}(k',j_g)$) for said HOA signal representation ($\tilde{C}(k')$) into its spatial domain representation ($\tilde{W}(k',j_g)$) and computing therefrom a corresponding covariance matrix, for each of the sub-band groups of the number ($N_{SB}$) of sub-band groups:

for all sub-bands of a sub-band group, combining said decorrelation covariance matrices so as to provide a sub-band group decorrelation covariance matrix $\tilde{\Sigma}_{DECO,g}(k'-1)$;

for all sub-bands of the sub-band group, combining the covariance matrices for said spatial domain representation ($\tilde{E}(k',j_g)$) of said complex-valued frequency domain sub-band representations ($\tilde{D}(k',j)$) so as to provide a sub-band group covariance matrix $\tilde{\Sigma}_{SPARS,g}(k'-1)$;

for all sub-bands of the sub-band group, combining the covariance matrices for said spatial domain representation ($\tilde{W}(k',j_g)$) of said complex-valued frequency domain sub-band representations ($\tilde{C}(k',j)$) for said HOA signal representation (C(k')) so as to provide a sub-band group covariance matrix $\tilde{\Sigma}_{ORIG,g}(k'-1)$;

forming the residual between the combined covariance matrices $\tilde{\Sigma}_{ORIG,g}(k'-1)$ and $\tilde{\Sigma}_{SPARS,g}(k'-1)$, so as to provide a matrix $\Delta\Sigma_g(k'-1)$;

computing, using matrix $\tilde{\Sigma}_{DECO,g}(k'-1)$ and matrix $\Delta\Sigma_g(k'-1)$, a corresponding mixing matrix ($M_g(k'-1)$);

encoding said mixing matrix so as to provide a parameter set ($\Gamma_{M_g}(k'-1)$) for the sub-band group;

multiplexing said parameter sets ($\Gamma_{M_g}(k'-1)$) for said sub-band groups and encoded sub-band configuration data ($\Gamma_{SUBBAND}$) and Parametric Ambience Replication coding parameters so as to provide a Parametric Ambience Replication parameter set ($\Gamma_{PAR}(k'-1)$).

2. A method of claim 1, wherein said mixing is performed in the frequency domain.

3. A method of claim 1, wherein said spatially sparse decoded HOA representation is represented by virtual loudspeaker signals from a number of predefined directions distributed on the unit sphere as uniformly as possible, and wherein for each of these predefined directions one uncorrelated signal is created by modifying the phase spectrum of the corresponding virtual loudspeaker signal using said de-correlation filters, and wherein said mixing of said modified phase spectra signals is performed such that for each virtual loudspeaker signal and its particular direction only modified phase spectra signals from the neighbourhood of that particular direction are used.

4. A method of claim 3, wherein said de-correlation filters are pairwise different and their number is equal to said number of predefined directions.

5. A method of claim 3, wherein said number of predefined directions varies in different frequency bands.

6. A method of claim 3, wherein an assignment of said virtual loudspeaker signals to said de-correlation filters is expressed by a permutation matrix.

7. An apparatus for improving a low bit rate compressed and decompressed Higher Order Ambisonics HOA signal representation (C(k)) of a sound field, so as to provide a Parametric Ambience Replication parameter set ($\Gamma_{PAR}(k'-1)$), wherein said decompression provides a spatially sparse decoded HOA representation (D(k')) and a set of indices ($\mathcal{J}_{used}(k')$) of coefficient sequences of this representation, said apparatus including means adapted to:

transform said spatially sparse decoded HOA representation (D(k')) into a number ($N_{FB}$) of complex-valued frequency domain sub-band representations ($\tilde{D}(k',j)$)

and transform using an analysis filter bank a correspondingly delayed version of said HOA signal representation ($C(k')$) into a corresponding number ($N_{FB}$) of complex-valued frequency domain sub-band representations ($\tilde{C}(k',j)$);

group said sub-bands representations ($\tilde{D}(k',j)$) into a number ($N_{SB}$) of sub-band groups, and within each of these sub-band groups:

create, using de-correlation filters, for each sub-band in a sub-band group from said complex-valued frequency domain sub-band representation ($\tilde{D}(k',j_g)$) a number of modified phase spectra signals ($\tilde{B}(k',j_g)$) which are uncorrelated with said complex-valued frequency domain sub-band representation ($\tilde{D}(k',j_g)$);

compute for each sub-band in the sub-band group from said modified phase spectra signals ($\tilde{B}(k',j_9)$) a decorrelation covariance matrix;

transform for each sub-band in the sub-band group said complex-valued frequency domain sub-band representation ($\tilde{D}(k',j_g)$) into its spatial domain representation ($\tilde{E}(k',j_g)$) and compute therefrom a corresponding covariance matrix;

transform for each sub-band in the sub-band group a complex-valued frequency domain sub-band representation ($\tilde{C}(k',j_9)$) for said HOA signal representation ($C(k')$) into its spatial domain representation ($\tilde{W}(k',j_g)$) and compute therefrom a corresponding covariance matrix, for each of the sub-band groups of the number ($N_{SB}$) of sub-band groups:

for all sub-bands of a sub-band group, combine said decorrelation covariance matrices so as to provide a sub-band group decorrelation covariance matrix $\tilde{\Sigma}_{DECO,g}(k'-1)$;

for all sub-bands of the sub-band group, combine the covariance matrices for said spatial domain representation ($\tilde{E}(k',j_g)$) of said complex-valued frequency domain sub-band representations ($\tilde{D}(k',j)$) so as to provide a sub-band group covariance matrix $\tilde{\Sigma}_{SPARS,g}(k'-1)$;

for all sub-bands of the sub-band group, combine the covariance matrices for said spatial domain representation ($\tilde{W}(k',j_g)$) of said complex-valued frequency domain sub-band representations ($\tilde{C}(k',j)$) for said HOA signal representation ($C(k')$) so as to provide a sub-band group covariance matrix $\tilde{\Sigma}_{ORIG,g}(k'-1)$;

form the residual between the combined covariance matrices $\tilde{\Sigma}_{ORIG,g}(k'-1)$ and $\tilde{\Sigma}_{SPARS,g}(k'-1)$, so as to provide a matrix $\Delta\Sigma_g(k'-1)$;

compute, using matrix $\tilde{\Sigma}_{DECO,g}(k'-1)$ and matrix $\Delta\Sigma_g(k'-1)$, a corresponding mixing matrix ($M_g(k'-1)$);

encode said mixing matrix so as to provide a parameter set ($\Gamma_{M_g}(k'-1)$) for the sub-band group;

multiplex said parameter sets ($\Gamma_{M_g}(k'-1)$) for said sub-band groups and encoded sub-band configuration data ($\Gamma_{SUBBAND}$) and Parametric Ambience Replication coding parameters so as to provide a Parametric Ambience Replication parameter set ($\Gamma_{PAR}(k'-1)$).

8. An apparatus of claim 7, wherein said mixing is performed in the frequency domain.

9. An apparatus of claim 7, wherein said spatially sparse decoded HOA representation is represented by virtual loudspeaker signals from a number of predefined directions distributed on the unit sphere as uniformly as possible, and wherein for each of these predefined directions one uncorrelated signal is created by modifying the phase spectrum of the corresponding virtual loudspeaker signal using said de-correlation filters, and wherein said mixing of said modified phase spectra signals is performed such that for each virtual loudspeaker signal and its particular direction only modified phase spectra signals from the neighbourhood of that particular direction are used.

10. An apparatus of claim 9, wherein said de-correlation filters are pairwise different and their number is equal to said number of predefined directions.

11. An apparatus of claim 9, wherein said number of predefined directions varies in different frequency bands.

12. An apparatus of claim 9, wherein an assignment of said virtual loudspeaker signals to said de-correlation filters is expressed by a permutation matrix.

13. A method for improving a spatially sparse decoded HOA representation ($\hat{D}(k)$), for which a set of indices ($\mathcal{J}_{used}(k)$) of coefficient sequences of this representation was provided by said decoding, using a Parametric Ambience Replication parameter set ($\Gamma_{PAR}(k)$), said method including:

reconstructing from said spatially sparse decoded HOA representation ($\hat{D}(k)$), said set of indices ($\mathcal{J}_{used}(k)$) of coefficient sequences and said Parametric Ambience Replication parameter set ($\Gamma_{PAR}(k)$) an improved HOA representation ($\hat{C}(k)$), said reconstructing including:

determining from said Parametric Ambience Replication parameter set ($\Gamma_{PAR}(k)$) a sub-band configuration;

converting said spatially sparse decoded HOA representation ($\hat{D}(k)$) into a number ($N_{FB}$) of frequency-band HOA representations ($\tilde{\hat{D}}(k,j)$);

according to said sub-band configuration, allocating corresponding groups of frequency-band HOA representations ($\tilde{\hat{D}}(k,j)$) together with related parameters to a corresponding number ($N_{SB}$) of Parametric Ambience Replication sub-band decoder steps or stages which create de-correlated coefficient sequences of a replicated ambience HOA representation ($\tilde{C}_{PAR}(k,j_g)$);

transforming said coefficient sequences of said replicated ambience HOA representation ($\tilde{C}_{PAR}(k,j_g)$) to a replicated time domain HOA representation ($C_{PAR}(k)$);

enhancing with said replicated time domain HOA representation ($C_{PAR}(k)$) said spatially sparse decoded HOA representation ($\hat{D}(k)$), so as to provide an enhanced decompressed HOA representation ($\hat{C}(k)$).

14. A method of claim 13, wherein from said spatially sparse decoded HOA representation ($\hat{D}(k)$), said set of indices 7 ($\mathcal{J}_{used}(k)$) of coefficient sequences and from received Ambience replication coding parameters ($o_{PAR,g}$, $n_{SIG,g}(k)$, $V_{COMPLEX,g}$) de-correlated spatial domain signal signals ($\tilde{\hat{B}}(k,j_g)$) are generated using de-correlation filters like de-correlation filters used at compressing side, and a mixing matrix ($\hat{M}_g(k)$) is provided, and wherein from said de-correlated spatial domain signals ($\tilde{\hat{B}}(k,j_g)$) spatial domain signals of the replicated ambient HOA representation ($\tilde{W}_{PAR}(k,j_g)$) are generated, and wherein said spatial domain signals of the replicated ambient HOA representation ($\tilde{W}_{PAR}(k,j_g)$) are transformed back into said replicated ambient HOA representation signals ($\tilde{C}_{PAR}(k,j_g)$) which are used for said enhancement.

15. A non-transitory computer readable media comprising instructions that, when executed on a computer, perform the method of claim 13.

16. An apparatus for improving a spatially sparse decoded HOA representation ($\hat{D}(k)$), for which a set of indices ($\mathcal{J}_{used}(k)$) of coefficient sequences of this representation was provided by said decoding, using a Parametric Ambience Replication parameter set ($\Gamma_{PAR}(k)$), said apparatus including means adapted to:

reconstruct from said spatially sparse decoded HOA representation ($\hat{D}(k)$), said set of indices ($\mathcal{J}_{used}(k)$) of coefficient sequences and said Parametric Ambience Replication parameter set ($\Gamma_{PAR}(k)$) an improved HOA representation ($\hat{C}(k)$), wherein that reconstruction includes:

determine from said Parametric Ambience Replication parameter set ($\Gamma_{PAR}(k)$) a sub-band configuration;

convert said spatially sparse decoded HOA representation ($\hat{D}(k)$) into a number ($N_{FB}$) of frequency-band HOA representations ($\tilde{\hat{D}}(k,j)$);

according to said sub-band configuration, allocate corresponding groups of frequency-band HOA representations ($\tilde{\hat{D}}(k,j)$) together with related parameters to a corresponding number ($N_{SB}$) of Parametric Ambience Replication sub-band decoder steps or stages which create de-correlated coefficient sequences of a replicated ambience HOA representation ($\tilde{C}_{PAR}(k,j_g)$);

transform said coefficient sequences of said replicated ambience HOA representation ($\tilde{C}_{PAR}(k,j_g)$) to a replicated time domain HOA representation ($C_{PAR}(k)$);

enhance with said replicated time domain HOA representation ($C_{PAR}(k)$) said spatially sparse decoded HOA representation ($\hat{D}(k)$), so as to provide an enhanced decompressed HOA representation ($\hat{C}(k)$).

17. An apparatus according to claim 16, wherein from said spatially sparse decoded HOA representation ($\hat{D}(k)$), said set of indices ($\mathcal{J}_{used}(k)$) of coefficient sequences and from received Ambience replication coding parameters ($o_{PAR,g}$, $n_{SIG,g}(k)$, $v_{COMPLEX,g}$) de-correlated spatial domain signal signals ($\tilde{\hat{B}}(k,j_g)$) are generated using de-correlation filters like de-correlation filters used at compressing side, and a mixing matrix ($\hat{M}_g(k)$) is provided, and wherein from said de-correlated spatial domain signals ($\tilde{\hat{B}}(k,j_g)$) spatial domain signals of the replicated ambient HOA representation ($\tilde{W}_{PAR}(k,j_g)$) are generated, and wherein said spatial domain signals of the replicated ambient HOA representation ($\tilde{W}_{PAR}(k,j_g)$) are transformed back into said replicated ambient HOA representation signals ($\tilde{C}_{PAR}(k,j_g)$) which are used for said enhancement.

* * * * *